US010996575B2

(12) United States Patent
Shimizu et al.

(10) Patent No.: US 10,996,575 B2
(45) **Date of Patent: *May 4, 2021**

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Tomofumi Shimizu, Osaka (JP); Kazuaki Ezure, Osaka (JP); Hayase Yamamoto, Osaka (JP); Jun Azuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/740,196

(22) Filed: Jan. 10, 2020

(65) Prior Publication Data

US 2020/0233324 A1 Jul. 23, 2020

(30) Foreign Application Priority Data

Jan. 18, 2019 (JP) ..... JP2019-006903
Jan. 18, 2019 (JP) ..... JP2019-006905

(51) Int. Cl.
*G03G 5/00* (2006.01)
*G03G 5/06* (2006.01)
(Continued)

(52) U.S. Cl.
CPC ..... *G03G 5/0614* (2013.01); *G03G 5/047* (2013.01); *G03G 5/0564* (2013.01);
(Continued)

(58) Field of Classification Search
CPC .... G03G 5/047; G03G 5/0675; G03G 5/0614; G03G 5/0679
(Continued)

(56) References Cited

U.S. PATENT DOCUMENTS 7,514,191 B2 4/2009 Yanus et al.
7,985,521 B2 * 7/2011 Wu ..... G03G 5/0605 430/58.75
(Continued)

FOREIGN PATENT DOCUMENTS

JP 2007-293342 A 11/2007

*Primary Examiner* — Mark A Chapman
(74) *Attorney, Agent, or Firm* — Studebaker & Brackett PC

(57) ABSTRACT

A photosensitive layer included in an electrophotographic photosensitive member contains at least a charge generating material, a hole transport material, and a binder resin. The hole transport material includes a compound (1). The binder resin includes a polyarylate resin having at least one repeating unit (10) and at least one repeating unit (11). Alternatively, the binder resin includes a polycarbonate resin having a repeating unit (20) and a repeating unit (21). The general formulas (1), (10), (11), (20), and (21) are as follows
(Continued)

(1)

(10)

(11)

(20)

-continued (21)

13 Claims, 3 Drawing Sheets

(51) Int. Cl.

| | |
|---|---|
| ***G03G 5/05*** | (2006.01) |
| ***G03G 15/00*** | (2006.01) |
| ***G03G 21/18*** | (2006.01) |
| ***G03G 5/047*** | (2006.01) |

(52) U.S. Cl.
CPC ..... *G03G 5/0618* (2013.01); *G03G 5/0668* (2013.01); *G03G 5/0675* (2013.01); *G03G 5/0677* (2013.01); *G03G 5/0679* (2013.01); *G03G 15/75* (2013.01); *G03G 21/1803* (2013.01)

(58) Field of Classification Search
USPC ..... 430/58.7
See application file for complete search history.

(56) References Cited

U.S. PATENT DOCUMENTS

2007/0254223 A1 11/2007 Yanus et al.
2007/0254226 A1 11/2007 Yanus et al.

* cited by examiner

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2019-006903, filed on Jan. 18, 2019 and Japanese Patent Application No. 2019-006905, filed on Jan. 18, 2019. The contents of the applications are incorporated herein by reference in their entirety.

BACKGROUND

The present disclosure relates to an electrophotographic photosensitive member, a process cartridge, and an image forming apparatus.

An electrophotographic photosensitive member is used as an image bearing member in an electrographic image forming apparatus (for example a printer or a multifunction peripheral). An electrophotographic photosensitive member includes a photosensitive layer. As the electrophotographic photosensitive member for example a single-layer electrophotographic photosensitive member or a multi-layer electrophotographic photosensitive member is used. The single-layer electrophotographic photosensitive member includes a single-layer photosensitive layer having a charge generating function and a charge transport function. The multi-layer electrophotographic photosensitive member includes a photosensitive layer including a charge generating layer having a charge generating function and a charge transport layer having a charge transport function.

A known example of the electrophotographic photosensitive member is an image forming member including at least one charge transport layer containing a terphenyldiamine charge transport component having a specific structure. The terphenyldiamine charge transport component is represented by for example chemical formula (II).

(II)

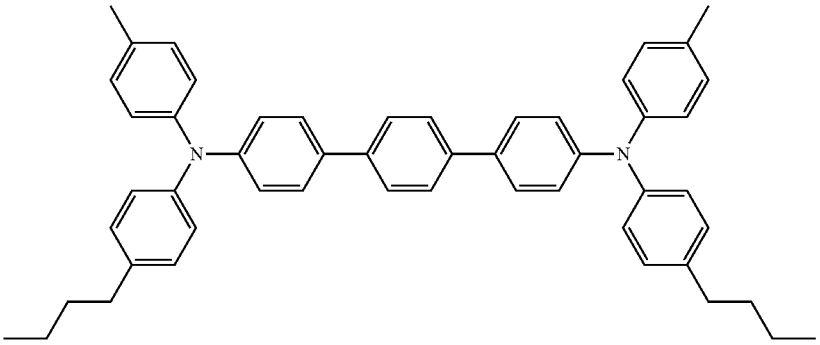

SUMMARY

An electrophotographic photosensitive member according to an aspect of the present disclosure includes a conductive substrate and a photosensitive layer. The photosensitive layer contains at least a charge generating material, a hole transport material, and a binder resin. The hole transport material includes a compound represented by general formula (1). The binder resin includes a polyarylate resin having at least one repeating unit represented by general formula (10) and at least one repeating unit represented by general formula (11). Alternatively, the binder resin includes a polycarbonate resin having a repeating unit represented by general formula (20) and a repeating unit represented by general formula (21).

(1)

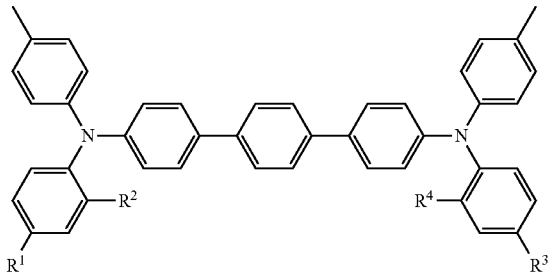

In general formula (1), $R^1$ and $R^2$ each represent, independently of one another, a hydrogen atom, a methyl group, or an ethyl group, and the sum of the carbon number of a group represented by $R^1$ and the carbon number of a group represented by $R^2$ is 2. $R^3$ and $R^4$ each represent, independently of each other, a hydrogen atom, a methyl group, or an ethyl group, and a sum of the carbon number of a group represented by $R^3$ and the carbon number of a group represented by $R^4$ is 2.

(10)

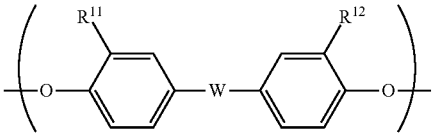

-continued (11)

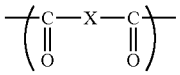

In general formula (10), $R^{11}$ and $R^{12}$ each represent, independently of each other, an alkyl group having a carbon number of at least 1 and no greater than 3. W represents a divalent group represented by general formula (W1), general formula (W2), or chemical formula (W3). In general formula (11), X represents a divalent group represented by chemical formula (X1), chemical formula (X2), or chemical formula (X3).

(W1)

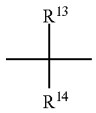

(W2)

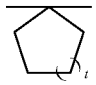

(W3)

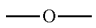

In general formula (W1), $R^{13}$ represents a hydrogen atom or an alkyl group having a carbon number of at least 1 and no greater than 4, and $R^{14}$ represents an alkyl group having a carbon number of at least 1 and no greater than 4. In general formula (W2), t represents an integer of at least 1 and no greater than 3.

(X1)

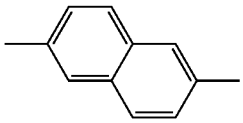

(X2)

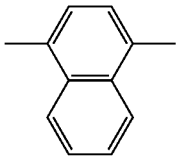

(X3)

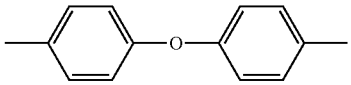

(20)

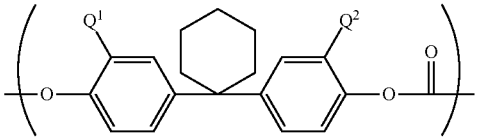

(21)

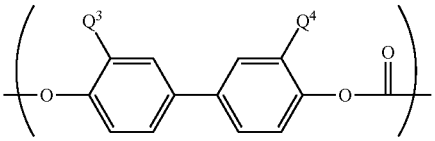

In general formulas (20) and (21), $Q^1$ and $Q^2$ each represent a hydrogen atom, and $Q^3$ and $Q^4$ each represent, independently of each other, an alkyl group having a carbon number of at least 1 and no greater than 6. Alternatively, $Q^1$ and $Q^2$ each represent, independently of each other, an alkyl group having a carbon number of at least 1 and no greater than 6, and $Q^3$ and $Q^4$ each represent a hydrogen atom.

A process cartridge according to an aspect of the present disclosure includes the electrophotographic photosensitive member described above.

An image forming apparatus according to an aspect of the present disclosure includes an image bearing member, a charger, a light exposure device, a developing device, and a transfer device. The charger charges a surface of the image bearing member. The light exposure device forms an electrostatic latent image on the charged surface of the image bearing member by exposing the surface of the image bearing member to light. The developing device develops the electrostatic latent image into a toner image. The transfer device transfers the toner image from the image bearing member to a transfer target. The image bearing member is the electrophotographic photosensitive member described above.

DETAILED DESCRIPTION

Figure 1:
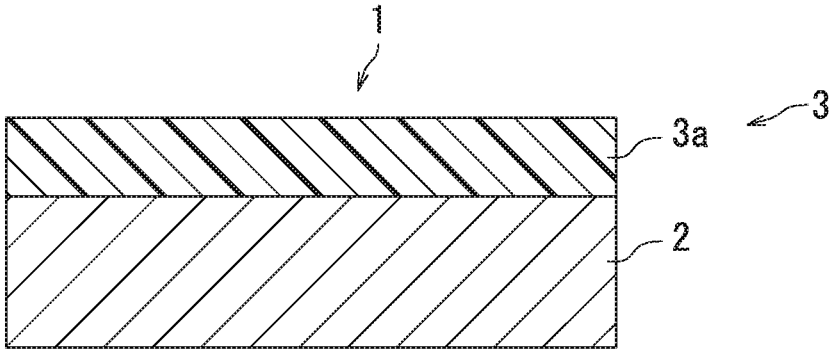
FIG. 1 is a partial cross sectional view of a single-layer electrophotographic photosensitive member as an example of an electrophotographic photosensitive member according to an embodiment of the present disclosure.

The following describes an embodiment of the present disclosure in detail. However, the present disclosure is by no means limited to the following embodiment. The present disclosure can be practiced within a scope of objects of the present disclosure with alterations made as appropriate. Although some overlapping explanations may be omitted as appropriate, such omission does not limit the gist of the present disclosure. In the following description, the term "-based" may be appended to the name of a chemical compound to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

First, substituents used herein will be described. Examples of halogen atoms (halogen groups) include a fluorine atom (a fluoro group), a chlorine atom (a chloro group), a bromine atom (a bromo group), and an iodine atom (an iodine group).

An alkyl group having a carbon number of at least 1 and no greater than 8, an alkyl group having a carbon number of at least 1 and no greater than 6, an alkyl group having a carbon number of at least 1 and no greater than 4, an alkyl group having a carbon number of at least 1 and no greater than 3, an alkyl group having a carbon number of 5, and an alkyl group having a carbon number of 4 as used herein are each an unsubstituted straight chain or branched chain alkyl group unless otherwise specified. Examples of the alkyl group having a carbon number of at least 1 and no greater than 8 include a methyl group, an ethyl group, an n-propyl group, an isopropyl group, an n-butyl group, a sec-butyl group, a tert-butyl group, an n-pentyl group, a 1-methylbutyl group, a 2-methylbutyl group, a 3-methylbutyl group, a 1-ethylpropyl group, a 2-ethylpropyl group, a 1,1-dimethylpropyl group, a 1,2-dimethylpropyl group, a 2,2-dimethylpropyl group, an n-hexyl group, a 1-methylpentyl group, a 2-methylpentyl group, a 3-methylpentyl group, a 4-methylpentyl group, a 1,1-dimethylbutyl group, a 1,2-dimethylbutyl group, a 1,3-dimethylbutyl group, a 2,2-dimethylbutyl group, a 2,3-dimethylbutyl group, a 3,3-dimethylbutyl group, a 1,1,2-trimethylpropyl group, a 1,2,2-trimethylpropyl group, a 1-ethylbutyl group, a 2-ethylbutyl group, a 3-ethylbutyl group, a straight chain or branched chain heptyl group, and a straight chain or branched chain octyl group. Examples of each of the alkyl group having a carbon number of at least 1 and no greater than 6, the alkyl group having a carbon number of at least 1 and no greater than 4, the alkyl group having a carbon number of at least 1 and no greater than 3, the alkyl group having a carbon number of 5, and the alkyl group having a carbon number of 4 are respective groups having corresponding carbon numbers among the groups listed above as examples of the alkyl group having a carbon number of at least 1 and no greater than 8.

An alkoxy group having a carbon number of at least 1 and no greater than 8 as used herein is an unsubstituted straight chain or branched chain alkoxy group unless otherwise specified. Examples of the alkoxy group having a carbon number of at least 1 and no greater than 8 include a methoxy group, an ethoxy group, an n-propoxy group, an isopropoxy group, an n-butoxy group, a sec-butoxy group, a tert-butoxy group, an n-pentoxy group, a 1-methylbutoxy group, a 2-methylbutoxy group, a 3-methylbutoxy group, a 1-ethylpropoxy group, a 2-ethylpropoxy group, a 1,1-dimethylpropoxy group, a 1,2-dimethylpropoxy group, a 2,2-dimethylpropoxy group, an n-hexyloxy group, a 1-methylpentyloxy group, a 2-methylpentyloxy group, a 3-methylpentyloxy group, a 4-methylpentyloxy group, a 1,1-dimethylbutoxy group, a 1,2-dimethylbutoxy group, a 1,3-dimethylbutoxy group, a 2,2-dimethylbutoxy group, a 2,3-dimethylbutoxy group, a 3,3-dimethylbutoxy group, a 1,1,2-trimethylpropoxy group, a 1,2,2-trimethylpropoxy group, a 1-ethylbutoxy group, a 2-ethylbutoxy group, a 3-ethylbutoxy group, a straight chain or branched chain heptyloxy group, and a straight chain or branched chain octyloxy group.

An aryl group having a carbon number of at least 6 and no greater than 14 as used herein is an unsubstituted aryl group unless otherwise specified. Examples of the aryl group having a carbon number of at least 6 and no greater than 14 include a phenyl group, a naphthyl group, an indacenyl group, a biphenylenyl group, an acenaphthylenyl group, an anthryl group, and a phenanthryl group. Substituents used herein have been described so far.

<Electrophotographic Photosensitive Member>

The present embodiment relates to an electrophotographic photosensitive member (also referred to below as a photosensitive member). The photosensitive member according to the present embodiment includes a conductive substrate and a photosensitive layer. The photosensitive layer contains at least a charge generating material, a hole transport material, and a binder resin. The photosensitive member is for example a single-layer electrophotographic photosensitive member (also referred to below as a single-layer photosensitive member) or a multi-layer electrophotographic photosensitive member (also referred to below as a multi-layer photosensitive member).

(Single-Layer Photosensitive Member)

Figure 2:
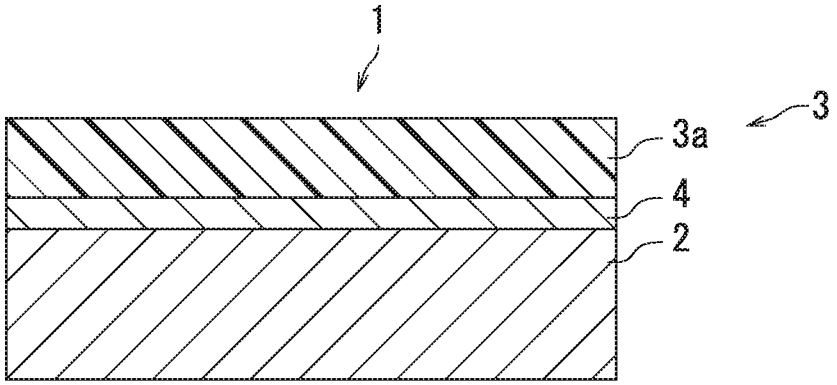
FIG. 2 is a partial cross sectional view of a single-layer electrophotographic photosensitive member as an example of the electrophotographic photosensitive member according to the embodiment of the present disclosure.
Figure 3:
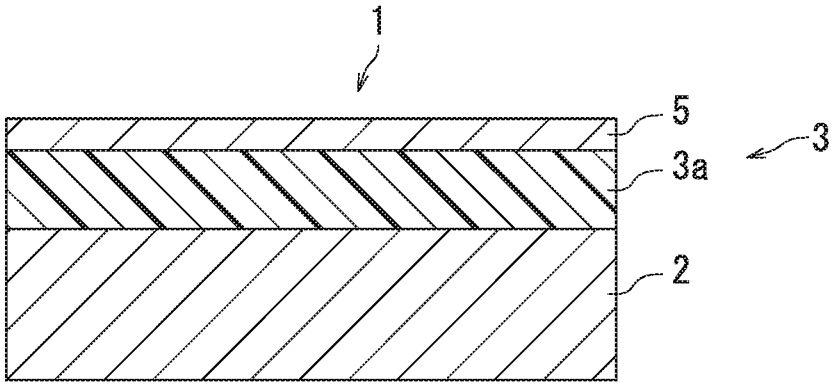
FIG. 3 is a partial cross sectional view of a single-layer electrophotographic photosensitive member as an example of the electrophotographic photosensitive member according to the embodiment of the present disclosure.

The following describes a single-layer photosensitive member 1 as an example of the photosensitive member with reference to FIGS. 1 to 3. FIGS. 1 to 3 are each a partial cross sectional view of a single-layer photosensitive member 1.

As illustrated in FIG. 1, the single-layer photosensitive member 1 includes for example a conductive substrate 2 and a photosensitive layer 3. The photosensitive layer 3 included in the single-layer photosensitive member 1 is a single layer. The "photosensitive layer 3 of a single layer" is also referred to below as a "single-layer photosensitive layer 3*a*".

As illustrated in FIG. 2, the single-layer photosensitive member 1 may include the conductive substrate 2, the single-layer photosensitive layer 3*a*, and an intermediate layer 4 (undercoat layer). The intermediate layer 4 is disposed between the conductive substrate 2 and the single-layer photosensitive layer 3*a*. The single-layer photosensitive layer 3*a* may be disposed directly on the conductive substrate 2 as illustrated in FIG. 1. Alternatively, the single-layer photosensitive layer 3*a* may be disposed on the conductive substrate 2 with the intermediate layer 4 therebetween as illustrated in FIG. 2.

The single-layer photosensitive member 1 may include the conductive substrate 2, the single-layer photosensitive layer 3*a*, and a protective layer 5 as illustrated in FIG. 3. The protective layer 5 is disposed on the single-layer photosensitive layer 3*a*. The single-layer photosensitive layer 3*a* may be disposed as an outermost surface layer of the single-layer photosensitive member 1 as illustrated in FIGS. 1 and 2. Alternatively, the protective layer 5 may be disposed as an outermost surface layer of the single-layer photosensitive member 1 as illustrated in FIG. 3.

The single-layer photosensitive layer 3*a* contains a charge generating material, a hole transport material, and a binder resin. The single-layer photosensitive layer 3*a* may further contain an electron transport material. The single-layer photosensitive layer 3*a* may contain an additive as necessary.

The thickness of the single-layer photosensitive layer 3*a* is not particularly limited, but is preferably at least 5 μm and no greater than 100 μm, and more preferably at least 10 μm and no greater than 50 μm. The single-layer photosensitive member 1 has been described so far with reference to FIGS. 1 to 3.

(Multi-Layer Photosensitive Member)

Figure 4:
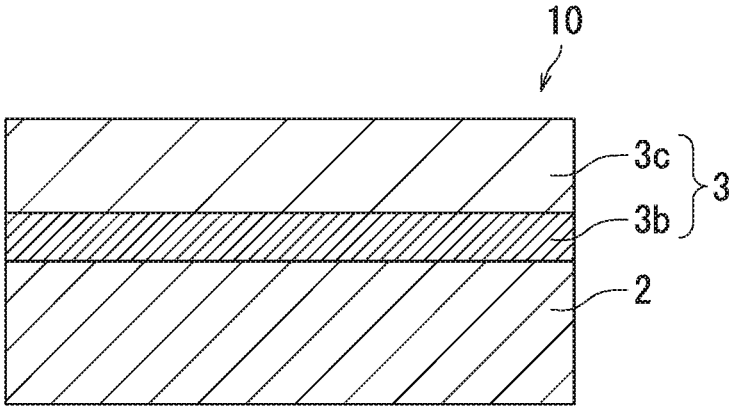
FIG. 4 is a partial cross sectional view of a multi-layer electrophotographic photosensitive member as an example of the electrophotographic photosensitive member according to the embodiment of the present disclosure.
Figure 5:
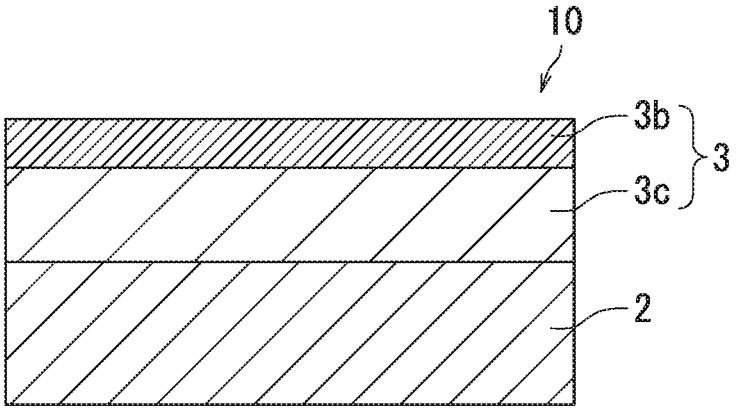
FIG. 5 is a partial cross sectional view of a multi-layer electrophotographic photosensitive member as an example of the electrophotographic photosensitive member according to the embodiment of the present disclosure.
Figure 6:
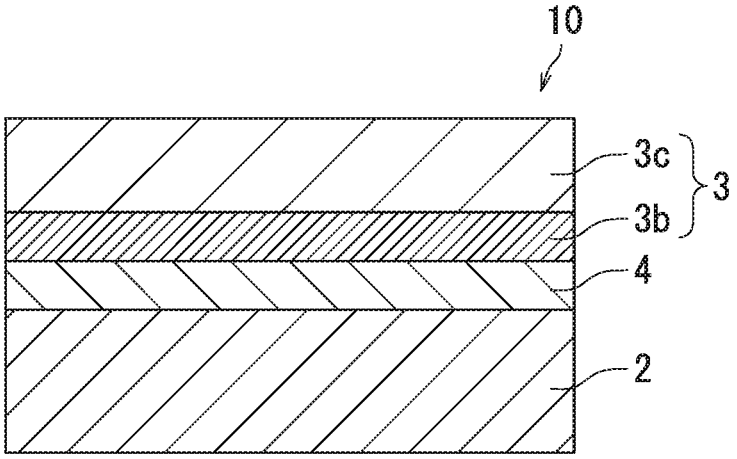
FIG. 6 is a partial cross sectional view of a multi-layer electrophotographic photosensitive member as an example of the electrophotographic photosensitive member according to the embodiment of the present disclosure.

The following describes a multi-layer photosensitive member 10 as an example of the photosensitive member with reference to FIGS. 4 to 6. FIGS. 4 to 6 are each a partial cross sectional view of a multi-layer photosensitive member 10.

The multi-layer photosensitive member 10 includes for example a conductive substrate 2 and a photosensitive layer 3 as illustrated in FIG. 4. The photosensitive layer 3 includes a charge generating layer 3*b* and a charge transport layer 3*c*. That is, the multi-layer photosensitive member 10 includes the charge generating layer 3*b* and the charge transport layer 3*c* as the photosensitive layer 3. The charge generating layer 3*b* is for example a single layer. The transport layer 3*c* is for example a single layer.

In the multi-layer photosensitive member 10, it is possible that the charge generating layer 3*b* is disposed on the conductive substrate 2, and the charge transport layer 3*c* is disposed on the charge generating layer 3*b* as illustrated in FIG. 4. Alternatively, in the multi-layer photosensitive member 10, it is possible that the charge transport layer 3*c* is disposed on the conductive substrate 2, and the charge generating layer 3*b* is disposed on the charge transport layer 3*c* as illustrated in FIG. 5.

The multi-layer photosensitive member 10 may include the conductive substrate 2, the photosensitive layer 3, and an intermediate layer 4 (undercoat layer) as illustrated in FIG. 6. The intermediate layer 4 is disposed between the conductive substrate 2 and the photosensitive layer 3. In the multi-layer photosensitive member 10, the photosensitive layer 3 may be disposed directly on the conductive substrate 2 as illustrated in FIGS. 4 and 5. Alternatively, in the multi-layer photosensitive member 10, the photosensitive layer 3 may be disposed on the conductive substrate 2 with the intermediate layer 4 therebetween as illustrated in FIG. 6. In a configuration in which the multi-layer photosensitive member 10 includes the intermediate layer 4, it is possible that the intermediate layer 4 is disposed on the conductive substrate 2, the charge generating layer 3*b* is disposed on the intermediate layer 4, and the charge transport layer 3*c* is disposed on the charge generating layer 3*b* as illustrated in FIG. 6. Alternatively, it is possible that the intermediate layer 4 is disposed on the conductive substrate 2, the charge transport layer 3*c* is disposed on the intermediate layer 4, and the charge generating layer 3*b* is disposed on the charge transport layer 3*c*.

The multi-layer photosensitive member 10 may include the conductive substrate 2, the photosensitive layer 3, and the protective layer 5 (see FIG. 3). The protective layer 5 is disposed on the photosensitive layer 3. The photosensitive layer 3 (for example the charge transport layer 3*c* or the charge generating layer 3*b*) may be disposed as an outermost surface layer of the multi-layer photosensitive member 10. Alternatively, the protective layer 5 may be disposed as an outermost surface layer of the multi-layer photosensitive member 10.

The charge generating layer 3*b* contains a charge generating material. The charge generating layer 3*b* may contain a binder resin (also be referred to below as a base resin) for charge generating layer formation. The charge generating layer 3*b* may contain an additive as necessary. The charge transport layer 3*c* contains a hole transport material and a binder resin. The charge transport layer 3*c* may contain an additive as necessary.

The thickness of the charge generating layer 3*b* is not particularly limited, but is preferably at least 0.01 μm and no greater than 5 μm, and more preferably at least 0.1 μm and no greater than 3 μm. The thickness of the charge transport layer 3*c* is not particularly limited, but is preferably at least 2 μm and no greater than 100 μm, and more preferably at least 5 μm and no greater than 50 μm. The multi-layer photosensitive member 10 has been described so far with reference to FIGS. 4 to 6. The following further describes the photosensitive member.

(Charge Generating Material)

Examples of the charge generating material include phthalocyanine pigments, perylene pigments, bisazo pigments, trisazo pigments, dithioketopyrrolopyrrole pigments, metal-free naphthalocyanine pigments, metal naphthalocyanine pigments, squaraine pigments, indigo pigments, azurenium pigments, cyanine pigments, powders of inorganic photoconductive materials (for example selenium, selenium-tellurium, selenium-arsenic, cadmium sulfide, and amorphous silicon), pyrylium pigments, ansanthrone pigments, triphenylmethane pigments, threne pigments, toluidine pigments, pyrazoline pigments, and quinacridone pigments The photosensitive layer (specifically, the charge generating layer or the single-layer photosensitive layer) may contain only one charge generating material or two or more charge generating materials.

Examples of the phthalocyanine pigments include metal-free phthalocyanine and metal phthalocyanine. Examples of the metal phthalocyanine include titanyl phthalocyanine, hydroxygallium phthalocyanine, and chlorogallium phthalocyanine. Metal-free phthalocyanine is represented by chemical formula (CGM-1). Titanyl phthalocyanine is represented by chemical formula (CGM-2).

(CGM-1)

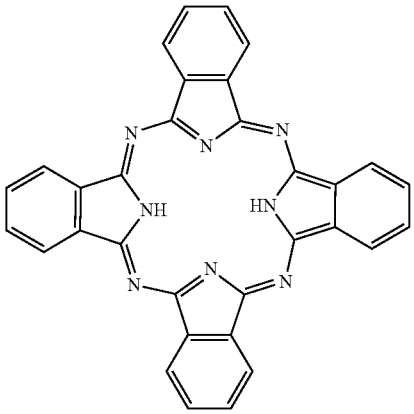

(CGM-2)

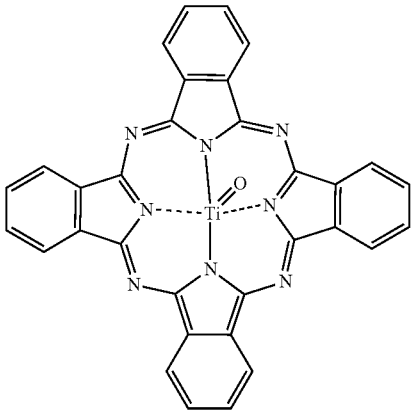

The phthalocyanine pigments may be crystalline or non-crystalline. An example of crystalline metal-free phthalocyanine is metal-free phthalocyanine having an X-form crystal structure (also referred to below as X-form metal-free phthalocyanine). Examples of crystalline titanyl phthalocyanine include titanyl phthalocyanine having an α-form crystal structure, titanyl phthalocyanine having a β-form crystal structure, and titanyl phthalocyanine having a Y-form crystal structure (also referred to below as α-form titanyl phthalocyanine, β-form titanyl phthalocyanine, and Y-form titanyl phthalocyanine, respectively).

For example, in a digital optical image forming apparatus (for example a laser beam printer or facsimile machine that uses a light source such as a semiconductor laser), a photosensitive member that is sensitive to a wavelength range of 700 nm or longer is preferably used. In terms of having high quantum yield in a wavelength range of 700 nm or longer, the charge generating material is preferably a phthalocyanine pigment, more preferably metal-free phthalocyanine or titanyl phthalocyanine, further preferably X-form metal-free titanyl phthalocyanine or Y-form titanyl phthalocyanine, and particularly preferably Y-form titanyl phthalocyanine.

Y-form titanyl phthalocyanine exhibits a main peak at a Bragg angle (2θ±0.2°) of for example 27.2° in a CuKα characteristic X-ray diffraction spectrum. The term main peak refers to a peak that exhibits a most intense or second most intense peak within a range of Bragg angles (2θ±0.2°) from 3° to 40° in a CuKα characteristic X-ray diffraction spectrum. Y-form titanyl phthalocyanine does not exhibit a peak at 26.2° in a CuKα characteristic X-ray diffraction spectrum.

The CuKα characteristic X-ray diffraction spectrum can be measured by, for example a method described below. First, a sample (titanyl phthalocyanine) is loaded into a sample holder of an X-ray diffraction spectrometer (for example "RINT (registered Japanese trademark) 1100", product of Rigaku Corporation) and an X-ray diffraction spectrum is measured using a Cu X-ray tube, a tube voltage of 40 kV, a tube current of 30 mA, and CuKα characteristic X-rays having a wavelength of 1.542 Å. The measurement range (2θ) is for example from 3° to 40° (start angle: 3°, stop angle: 40°), and the scanning speed is for example 10°/minute. A main peak in the obtained X-ray diffraction spectrum is determined, and the Bragg angle of the main peak is read therefrom.

When the photosensitive member is a single-layer photosensitive member, the amount of the charge generating material is preferably at least 0.1 parts by mass and no greater than 50 parts by mass relative to 100 parts by mass of the binder resin, and more preferably at least 0.5 parts by mass and no greater than 4.5 parts by mass. When the photosensitive member is a multi-layer photosensitive member, the amount of the charge generating material is preferably at least 10 parts by mass and no greater than 300 parts by mass relative to 100 parts by mass of the base resin, and more preferably at least 100 parts by mass and no greater than 200 parts by mass.

(Hole Transport Material)

The hole transport material includes a compound represented by the following general formula (1) (also be referred to below as compounds (1)). The photosensitive layer (the single-layer photosensitive layer or the charge transport layer) contains the compound (1) as the hole transport material.

(1)

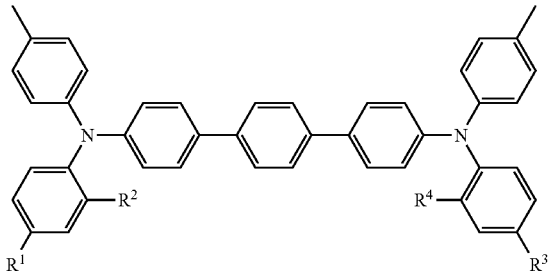

In general formula (1). $R^1$ and $R^2$ each represent, independently of each other, a hydrogen atom, a methyl group, or an ethyl group, and the sum of the carbon number of the group represented by $R^1$ and the carbon number of the group represented by $R^2$ is 2. $R^3$ and $R^4$ each represent, independently of each other, a hydrogen atom, a methyl group, or an ethyl group, and the sum of the carbon number of the group represented by $R^3$ and the carbon number of the group represented by $R^4$ is 2.

"$R^1$ and $R^2$ each representing, independently of each other, a hydrogen atom, a methyl group, or an ethyl group, and the sum of the carbon number of the group represented by $R^1$ and the carbon number of the group represented by $R^2$ being 2; and $R^3$ and $R^4$ each representing, independently of each other, a hydrogen atom, a methyl group, or an ethyl group, and the sum of the carbon number of the group represented by $R^3$ and the carbon number of the group represented by $R^4$ being 2" may be referred to below as "the corresponding substituents being predetermined substituents". Also, "$R^1$ being at a para position of a phenyl group, $R^2$ being at an ortho position of the phenyl group, $R^3$ being at a para position of a phenyl group, and $R^4$ being at the ortho position of the phenyl group" may be referred to below as "the corresponding substituents being each at a predetermined position".

As a result of the photosensitive layer containing the compound (1) as the hole transport material, it is possible to improve charging stability of the photosensitive member and inhibit crystallization of the photosensitive layer. Presumably, the reason therefor is as follows. Note that the charging stability is a characteristic that allows the photosensitive member to be charged to a charge potential within a specific range even after image formation on a recording medium is repeated. In order to facilitate explanation, A and B are shown in the following general formula (1), and the phenyl groups represented by A and B are referred to as phenyl groups A and B, respectively.

(1)

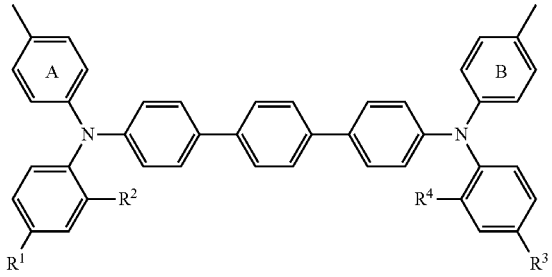

The first reason is as follows. $R^1$ to $R^4$ in general formula (1) are predetermined substituents, which are not bulky. The unbulky substituents represented by $R^1$ to $R^4$ tend to fill minute gaps in the photosensitive layer. In addition, as a result of $R^1$ to $R^4$ being located at the predetermined positions, $R^1$ to $R^4$ more easily fill the minute gaps in the photosensitive layer. For this reason, as a result of $R^1$ to $R^4$ being predetermined substituents and being located at the predetermined positions, it is possible to prevent an extraneous component (for example a gas) that may cause degradation of the photosensitive member from entering the photosensitive layer even in a situation where image formation on a recording medium is repeated. Accordingly, charging stability of the photosensitive member is improved.

The second reason is as follows. $R^1$ to $R^4$ in general formula (1) are predetermined substituents and located at the predetermined positions. When each of $R^1$ to $R^4$ in general formula (1) is not a predetermined substituent (for example is a methoxy group or a butyl group) or is not located at the corresponding predetermined position, the hole transport material has an impaired hole transport ability, thereby impairing charging stability. As a result of each of $R^1$ to $R^4$ in general formula (1) being a predetermined substituent located at the corresponding predetermined position, hole transport ability of the compound (1) is improved, thereby improving the charging stability of the photosensitive member.

The third reason is as follows. In general, a compound having a terphenyl structure tends to cause crystallization of the photosensitive layer. As a result of intensive investigation, the present inventors found that it is possible to inhibit crystallization of the photosensitive layer when each of $R^1$ to $R^4$ in general formula (1) is a predetermined substituent located at the corresponding predetermined position and the phenyl groups A and B each have a methyl group at the para position thereof. Due to the presence of the predetermined substituents located at the predetermined positions and the methyl groups at the para positions of the phenyl groups A and B, an appropriate distance for preventing an excessively strong intermolecular force is provided between the compound (1) and other molecules contained in the photosensitive layer. As a result, crystallization of the photosensitive layer can be inhibited.

The fourth reason is as follows. As described above, $R^1$ to $R^4$ in general formula (1) are predetermined substituents, which are not bulky. A compound having a bulky substituent (for example a phenyl butadienyl group or a butyl group) tends to cause crystallization of the photosensitive layer. $R^1$ to $R^4$ are at the corresponding predetermined positions. As a result of $R^1$ to $R^4$ each being a predetermined substituent that is not bulky and located at the corresponding predetermined position, crystallization of the photosensitive layer can be inhibited. The reasons for improvement in charging stability of the photosensitive member and for inhibition of crystallization of the photosensitive layer have been described so far.

Preferable examples of the compound (1) include compounds represented by chemical formulas (1-1), (1-2), and (1-3) (also referred to below as compounds (1-1), (1-2), and (1-3), respectively). In order to markedly inhibit crystallization of the photosensitive layer, the compound (1-1) or (1-2) is more preferable as the compound (1).

(1-1)

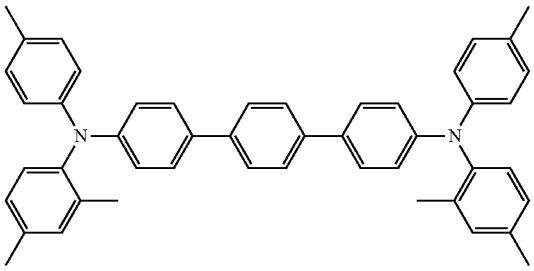

-continued (1-2)

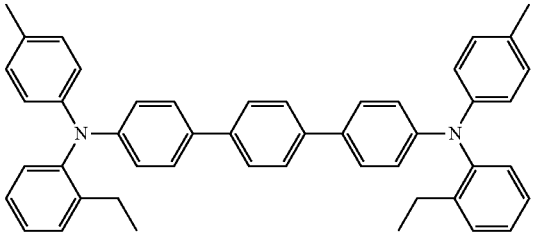

(1-3)

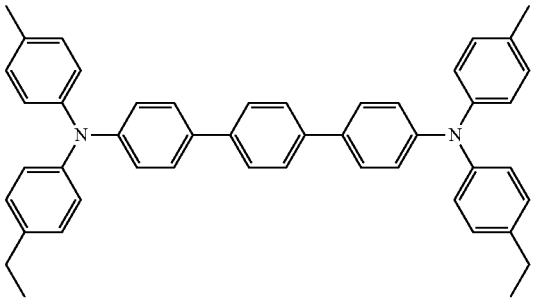

The amount of the hole transport material is preferably at least 10 parts by mass relative to 100 parts by mass of the binder resin, more preferably at least 50 parts by mass, and still more preferably at least 65 parts by mass. The amount of the hole transport material is preferably no greater than 300 parts by mass relative to 100 parts by mass of the binder resin, more preferably no greater than 100 parts by mass, and still more preferably no greater than 75 parts by mass.

The photosensitive layer may contain only one compound (1) as the hole transport material. Alternatively, the photosensitive layer may contain two or more compounds (1) as the hole transport material. Also, the photosensitive layer may contain only the compound (1) as the hole transport material. Alternatively, the photosensitive layer may further contain a hole transport material that is not the compound (1) (also referred to below as an additional hole transport material) in addition to the compound (1).

Examples of the additional hole transporting material include oxadiazole-based compounds (for example 2,5-di(4-methylaminophenyl)-1,3,4-oxadiazole), styryl compounds (for example 9-(4-diethylaminostyryl)anthracene), carbazole compounds (for example polyvinyl carbazole), organic polysilane compounds, pyrazoline-based compounds (for example 1-phenyl-3-(p-dimethylaminophenyl) pyrazoline), hydrazone compounds, indole-based compounds, oxazole-based compounds, isoxazole-based compounds, thiazole-based compounds, thiadiazole-based compounds, imidazole-based compounds, pyrazole-based compounds, and triazole-based compounds.

The compound (1) can be produced for example through a reaction represented by the following reaction formula (r1) (also referred to below as a reaction (r1)). Y in general formula (a) in reaction formula (r1) represents a halogen atom. $R^1$, $R^2$, $R^3$, and $R^4$ in general formulas (b) and (c) are defined the same as $R^1$, $R^2$, $R^3$, and $R^4$ in general formula (1), respectively. The compounds represented by general formulas (a), (b), (c), and (d) may be referred to below as compounds (a), (b), (c), and (d), respectively.

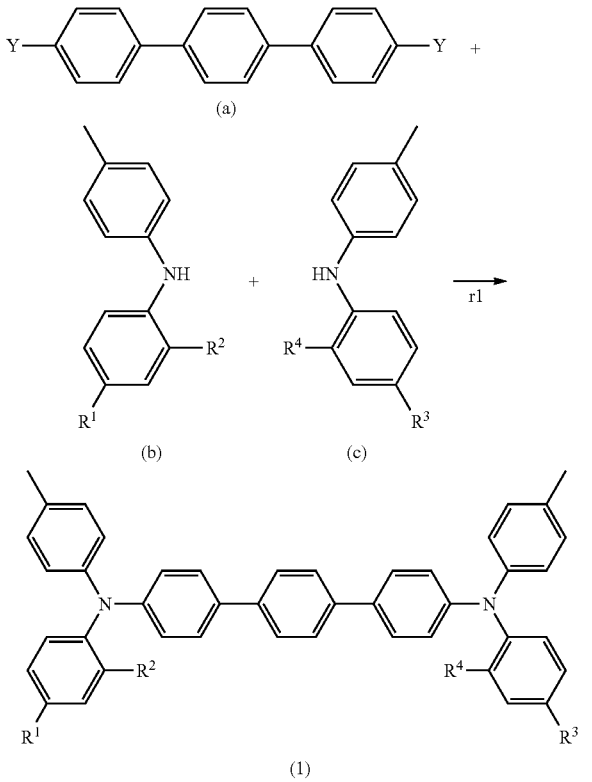

In reaction (r1), 1 molar equivalent of the compound (a), 1 molar equivalent of the compound (b), and 1 molar equivalent of the compound (c) are reacted to give 1 molar equivalent of the compound (1). When $R^1$ and $R^3$ are the same as each other and $R^2$ and $R^4$ are the same as each other in general formula (1), 2 molar equivalents of the compound (b) are used instead of 1 molar equivalent of the compound (b) and 1 molar equivalent of the compound (c).

The reaction (r1) may be carried out in the presence of a palladium catalyst. Examples of the palladium catalyst include palladium(II) acetate, palladium(II) chloride, hexachloropalladium(IV) sodium tetrahydrate, and tris(dibenzylideneacetone)dipalladium(0).

The reaction (r1) may be carried out in the presence of a ligand. Examples of the ligand include (4-dimethylaminophenyl)di-tertbutylphosphine, tricyclohexylphosphine, triphenylphosphine, and methyldiphenylphosphine.

The reaction (r1) may be carried out in the presence of a base. Examples of the base include sodium tert-butoxide, tripotassium phosphate, and cesium fluoride. The amount of the base is preferably at least 1 molar equivalent and no greater than 10 molar equivalents relative to 1 molar equivalent of the compound (b).

The reaction (r1) may be carried out in a solvent. Examples of the solvent include xylene, toluene, tetrahydrofuran, and dimethylformamide.

The reaction (r1) is preferably carried out at a reaction temperature of 80° C. or higher and 140° C. or lower. The reaction (r1) is preferably carried out for a reaction time of 1 hour or longer and 10 hours or shorter. The reaction (r1) may be carried out in an inert gas atmosphere (for example an argon gas atmosphere).

(Binder Resin)

The binder resin includes a polyarylate resin having at least one repeating unit represented by general formula (10) and at least one repeating unit represented by general formula (11), or a polycarbonate resin having a repeating unit represented by general formula (20) and a repeating unit represented by general formula (21). The "polyarylate resin having at least one repeating unit represented by general formula (10) and at least one repeating unit represented by general formula (11)" is also referred to below as a "polyarylate resin (PA)". The "polycarbonate resin having a repeating unit represented by general formula (20) and a repeating unit represented by general formula (21)" is also referred to below as a "polycarbonate resin (PC)".

(Polyarylate Resin (PA))

The following describes a case where the binder resin includes the polyarylate resin (PA). As described above, the polyarylate resin (PA) has at least one repeating unit represented by general formula (10) and at least one repeating unit represented by general formula (11). Repeating units represented by general formulas (10) and (11) are also referred to below as repeating units (10) and (11), respectively.

(10)

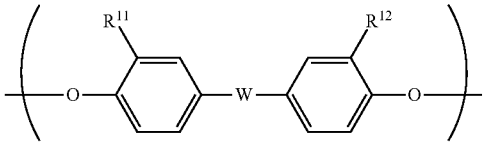

(11)

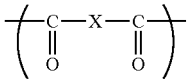

In general formula (10), $R^{11}$ and $R^{12}$ each represent, independently of each other, an alkyl group having a carbon number of at least 1 and no greater than 3. In general formula (10), W represents a divalent group represented by general formula (W1), general formula (W2), or chemical formula (W3).

(W1)

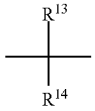

(W2)

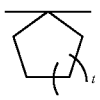

(W3)

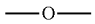

In general formula (W1), $R^{13}$ represents a hydrogen atom or an alkyl group having a carbon number of at least 1 and no greater than 4, and $R^{14}$ represents an alkyl group having a carbon number of at least 1 and no greater than 4. In general formula (W2), t represents an integer of at least 1 and no greater than 3.

In general formula (11), X represents a divalent group represented by chemical formula (X1), chemical formula (X2), or chemical formula (X3).

(X1)

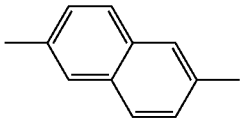

(X2)

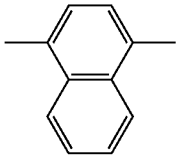

(X3)

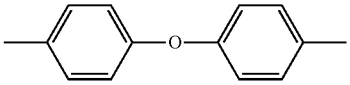

As a result of the polyarylate resin (PA) having a predetermined chemical structure, it is possible to improve charging stability of the photosensitive member and inhibit crystallization of the photosensitive layer. The alkyl groups having a carbon number of at least 1 and no greater than 3 and being represented by $R^{11}$ and $R^{12}$ in general formula (10) in the polyarylate resin (PA) tend to fill minute gaps in the photosensitive layer. For this reason, in a situation where image formation on a recording medium is repeated, it is possible to prevent an extraneous component (for example a gas) that may cause degradation of the photosensitive member from entering the photosensitive layer, thereby further improving charging stability of the photosensitive member.

The alkyl groups having a carbon number of at least 1 and no greater than 3 and being represented by $R^{11}$ and $R^{12}$ in general formula (10) are each preferably a methyl group or an ethyl group, and more preferably a methyl group. $R^{11}$ and $R^{12}$ in general formula (10) each preferably represent a methyl group.

The alkyl groups having a carbon number of at least 1 and no greater than 4 and being represented by $R^{13}$ and $R^{14}$ in general formula (W1) are each preferably a methyl group or an ethyl group, and more preferably a methyl group. It is preferable that $R^{13}$ represents a hydrogen atom and $R^{14}$ represents a methyl group in general formula (W1). In general formula (W2), t preferably represents 2.

Preferable examples of the repeating unit (10) include repeating units represented by chemical formulas (10-1) and (10-2) (also referred to below as repeating units (10-1) and (10-2), respectively).

(10-1)

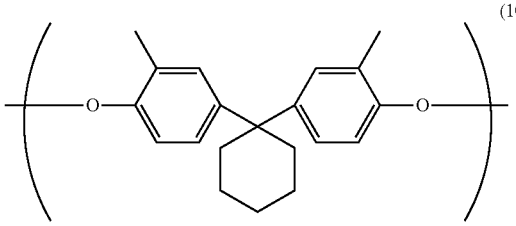

(10-2)

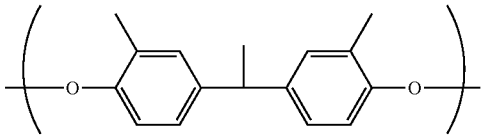

Preferable examples of the repeating unit (11) include repeating units represented by chemical formulas (11-1) and (11-2) (also referred to below as repeating units (11-1) and (11-2), respectively).

(11-1)

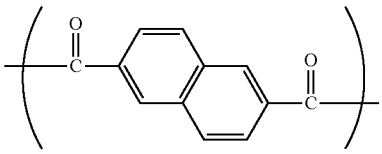

(11-2)

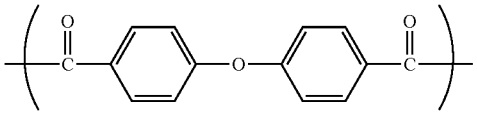

The polyarylate resin (PA) preferably has at least one type (for example one, two, or three types) of repeating unit (10) and at least two types (for example two or three types) of repeating unit (11). In a case where the polyarylate resin (PA) has at least two types of repeating units (11), the polyarylate resin (PA) preferably has at least repeating units (11-1) and (11-2) as the repeating unit (11).

The polyarylate resin (PA) more preferably has one repeating unit (10) and two types of repeating unit (11). In a case where the polyarylate resin (PA) has two types of repeating units (11), the polyarylate resin (PA) preferably has repeating units (11-1) and (11-2) as the repeating unit (11).

In a case where the polyarylate resin (PA) has repeating units (11-1) and (11-2), a ratio of the number of repeating unites (11-1) to the total number of repeating units (11-1) and (11-2) (also referred to below as a ratio p) is preferably at least 10% and no greater than 90%, more preferably at least 20% and no greater than 80%, still more preferably at least 30% and no greater than 70%, further more preferably at least 40% and no greater than 60%, and particularly preferably 50%.

Preferable examples of the polyarylate resin (PA) include a first polyarylate resin and a second polyarylate resin. The first polyarylate resin has a repeating unit (10-1), a repeating unit (11-1), and a repeating unit (11-2) as shown in the following chemical formulas.

(10-1)

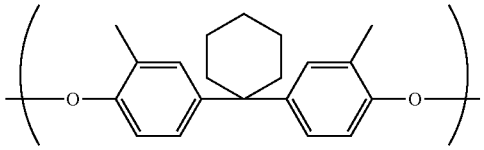

(11-1)

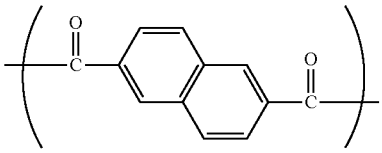

-continued (11-2)

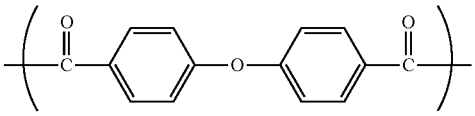

The second polyarylate resin has a repeating unit (10-2), a repeating unit (11-1), and a repeating unit (11-2) as shown in the following chemical formulas.

(10-2)

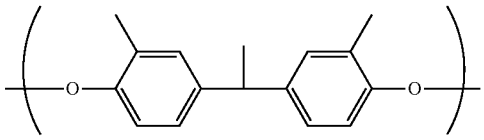

(11-1)

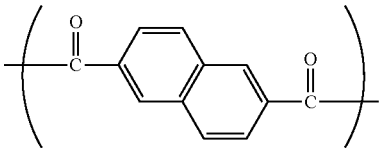

(11-2)

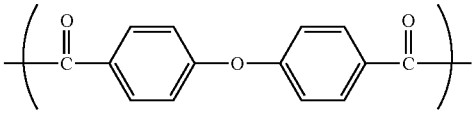

Preferable examples of the first polyarylate resin include a polyarylate resin represented by chemical formula (R-1) shown below (also referred to below as polyarylate resin (R-1)). Preferable examples of the second polyarylate resin include a polyarylate resin represented by chemical formula (R-2) shown below (also referred to below as polyarylate resin (R-2)). In chemical formulas (R-1) and (R-2), the number attached to the lower right of each repeating unit indicates a ratio of the number of corresponding repeating units to the total number of repeating units in the polyarylate resin (unit: %).

each other. In a case where the polyarylate resin (PA) is a copolymer, the polyarylate resin (PA) may be any of a random copolymer, an alternating copolymer, a periodic copolymer, and a block copolymer.

The polyarylate resin (PA) may have only the repeating units (10) and (11) as repeating units. The polyarylate resin (PA) may further have, in addition to repeating units (10) and (11), a repeating unit other than the repeating units (10) and (11).

In a case where the binder resin is a polyarylate resin (PA), the polyarylate resin (PA) has a viscosity average molecular weight preferably of at least 10,000, more preferably of at least 20,000, further preferably of at least 30,000, and particularly preferably of at least 40,000. As a result of the polyarylate resin (PA) having a viscosity average molecular weight of at least 10,000, abrasion resistance of the polyarylate resin (PA) can be increased. Thus, abrasion of the photosensitive layer can be inhibited. On the other hand, the polyarylate resin (PA) has a viscosity average molecular weight preferably of no greater than 80,000, and more preferably of no greater than 70,000. As a result of the polyarylate resin (PA) having a viscosity average molecular weight of no greater than 80,000, the polyarylate resin (PA) is easy to dissolve in a solvent for photosensitive layer formation. Thus, formation of the photosensitive layer can be facilitated.

No particular limitations are placed on a production method of the polyarylate resin (PA). An example of the production method of the polyarylate resin (PA) is condensation polymerization of an aromatic diol for forming a repeating unit (10) and an aromatic dicarboxylic acid for forming a repeating unit (11). A known synthesis method (specific examples include solution polymerization, melt polymerization, and interface polymerization) can be selected as a method for the condensation polymerization.

The aromatic diol for forming a repeating unit (10) is a compound represented by general formula (BP-10) (also referred to below as compound (BP-10)). The aromatic dicarboxylic acid for forming a repeating unit (11) is a compound represented by general formula (DC-11) (also referred to below as compound (DC-11)). $R^{11}$, $R^{12}$, W, and (R-1)

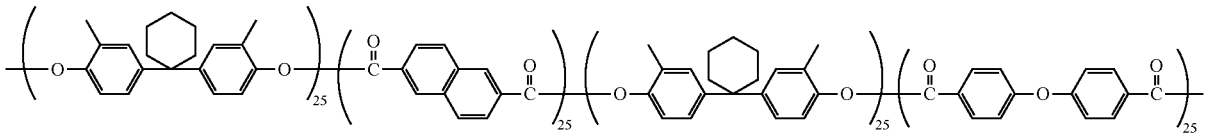

(R-2)

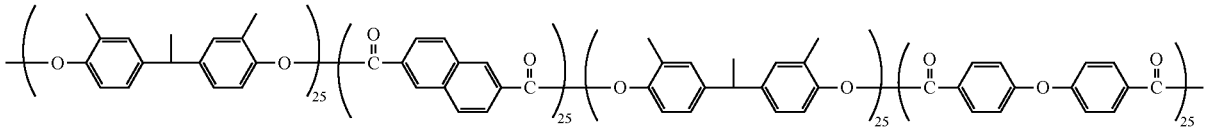

In the polyarylate resin (PA), a repeating unit (10) derived from an aromatic diol and a repeating unit (11) derived from an aromatic dicarboxylic acid are adjacent and bonded to X in general formulas (BP-10) and (DC-11) are defined the same as $R^{11}$, $R^{12}$, W, and X in general formulas (10) and (11), respectively.

(BP-10)

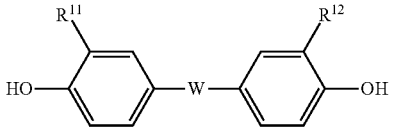

(DC-11)

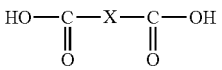

Preferable examples of the compound (BP-10) include compounds represented by chemical formulas (BP-10-1) and (BP-10-2) (also referred to below as compounds (BP-10-1) and (BP-10-2), respectively).

(BP-10-1)

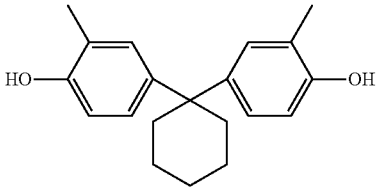

(BP-10-2)

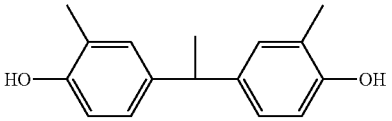

Preferable examples of the compound (DC-11) include compounds represented by chemical formulas (DC-11-1) and (DC-11-2) (also referred to below as compounds (DC-11-1) and (DC-11-2), respectively).

(DC-11-1)

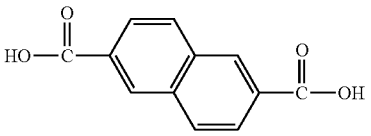

(DC-11-2)

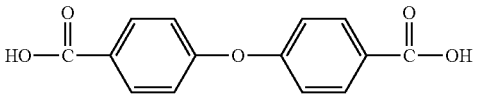

The aromatic diol (for example the compound (BP-10)) may be transformed for use into an aromatic diacetate. The aromatic dicarboxylic acid (for example the compound (DC-11)) may be derivatized for use. Examples of a derivative of the aromatic dicarboxylic acid include an aromatic dicarboxylic acid dichloride, an aromatic dicarboxylic acid dimethyl ester, an aromatic dicarboxylic acid diethyl ester, and an aromatic dicarboxylic acid anhydride. The aromatic dicarboxylic acid dichloride is a compound obtainable by replacing two "—C(═O)—OH" groups of the aromatic dicarboxylic acid each with a "—C(═O)—Cl" group.

Either or both a base and a catalyst may be added in condensation polymerization of the aromatic diol and the aromatic dicarboxylic acid. The base and the catalyst may be respectively selected from known bases and known catalysts as appropriate. An example of the base is sodium hydroxide. Examples of the catalyst include benzyltributylammonium chloride, ammonium chloride, ammonium bromide, a quaternary ammonium salt, triethylamine, and trimethylamine.

(Polycarbonate Resin (PC))

Next, a case where the binder resin includes the polycarbonate resin (PC) will be described. As described above, the polycarbonate resin (PA) has a repeating unit represented by general formula (20) and a repeating unit represented by general formula (21). The "repeating unit represented by general formula (20)" is also referred to below as a "repeating unit (20)" and the "repeating unit represented by general formula (21)" is also referred to below as a "repeating unit (20)".

(20)

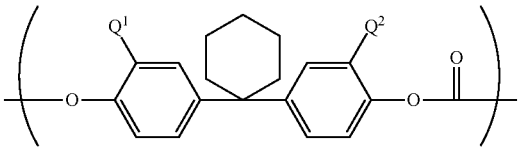

(21)

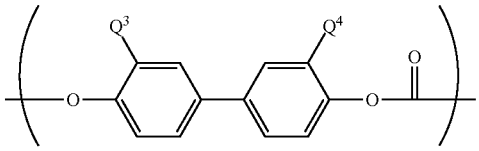

In general formulas (20) and (21), $Q^1$ and $Q^2$ each represent a hydrogen atom, and $Q^3$ and $Q^4$ each represent, independently of each other, an alkyl group having a carbon number of at least 1 and no greater than 6. Alternatively, $Q^1$ and $Q^2$ each represent, independently of each other, an alkyl group having a carbon number of at least 1 and no greater than 6, and $Q^3$ and $Q^4$ each represent a hydrogen atom.

As a result of the photosensitive layer containing the polycarbonate resin (PC) as the binder resin, it is possible to improve charging stability of the photosensitive member and inhibit crystallization of the photosensitive layer. Presumably, the reason therefor is as follows.

The alkyl groups having a carbon number of at least 1 and no greater than 6 and being represented by $Q^1$ to $Q^4$ in general formulas (20) and (21) tend to fill minute gaps in the photosensitive layer. For this reason, in a situation where image formation on a recording medium is repeated, it is possible to prevent an extraneous component (for example a gas) that may cause degradation of the photosensitive member from entering the photosensitive layer. Accordingly, charging stability of the photosensitive member is improved. However, when excessively many alkyl groups having a carbon number of at least 1 and no greater than 6 are present in the polycarbonate resin, crystallization of the photosensitive layer is caused. Therefore, in order to appropriately adjust the number of alkyl groups having a carbon number of at least 1 and no greater than 6 included in the polycarbonate resin, in general formulas (20) and (21), it is satisfied that $Q^1$ and $Q^2$ each represent a hydrogen atom and $Q^3$ and $Q^4$ each represent, independently of each other, an alkyl group having a carbon number of at least 1 and no greater than 6, or that $Q^1$ and $Q^2$ each represent, independently of each other, an alkyl group having a carbon number of at least 1 and no greater than 6 and $Q^3$ and $Q^4$ each represent a hydrogen atom". Through the above, improvement of charging stability of the photosensitive member and inhibition of crystallization of the photosensitive layer can be both achieved. In particular, when the photosensitive layer contains both the polycarbonate resin (PC) and the compound (1) that is a hole transporting material, these advantages are remarkable.

$Q^1$, $Q^2$, $Q^3$ and $Q^4$ in general formulas (20) and (21) are each preferably an alkyl group having a carbon number of at least 1 and no greater than 3, and more preferably a methyl group.

In order to improve charging stability and inhibit crystallization of the photosensitive layer, a ratio of the number of the repeating units (20) to the total number of the repeating units (20) and (21) is preferably at least 30% and no greater than 90%, more preferably at least 40% and no greater than 80%, still more preferably at least 50% and no greater than 70%, and particularly preferably at least 55% and no greater than 65%. The "ratio of the number of the repeating units (20) to the total number of the repeating units (20) and (21)" may be referred to below as "ratio n". The ratio n is an average value of values obtained from the entirety (a plurality of resin chains) of the polycarbonate resin (PC) rather than a value obtained from one resin chain.

In order to improve charging stability and inhibit crystallization of the photosensitive layer, the polycarbonate resin (PC) is preferably a polycarbonate resin having a repeating unit represented by chemical formula (20-1) and a repeating unit represented by chemical formula (21-1). The repeating unit represented by chemical formula (20-1)" is also referred to below as a "repeating unit (20-1)" and the "repeating unit represented by chemical formula (21-1)" is also referred to below as a "repeating unit (21-1)". The "polycarbonate resin having a repeating unit (20-1) and a repeating unit (21-1)" is also referred to below as a "first polycarbonate resin".

(20-1)

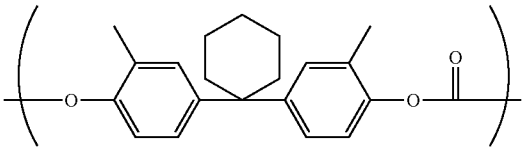

-continued (21-1)

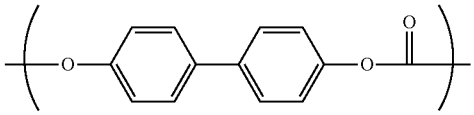

In order to improve charging stability and inhibit crystallization of the photosensitive layer, a polycarbonate resin having a repeating unit represented by chemical formula (20-2) and a repeating unit represented by chemical formula (21-2) is also preferable as the polycarbonate resin (PC). The "repeating unit represented by chemical formula (20-2)" is also referred to below as a "repeating unit (20-2)" and the "repeating unit represented by chemical formula (21-2)" is also referred to below as a "repeating unit (21-2)". "A polycarbonate resin having a repeating unit (20-2) and a repeating unit (21-2)" is also referred to below as "a second polycarbonate resin".

(20-2)

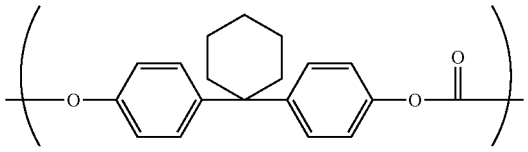

(21-2)

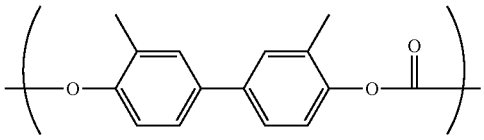

Preferable examples of the first polycarbonate resin include a polycarbonate resin represented by chemical formula (PC-1) shown below (also referred to below as polycarbonate resin (PC-1)). Preferable examples of the second polycarbonate resin include a polycarbonate resin represented by chemical formula (PC-2) shown below (also referred to below as polycarbonate resin (PC-2)). In chemical formulas (PC-1) and (PC-2), the number attached to the lower right of each repeating unit indicates a ratio of the number of corresponding repeating units to the total number of repeating units in the polycarbonate resin (unit: %).

(PC-1)

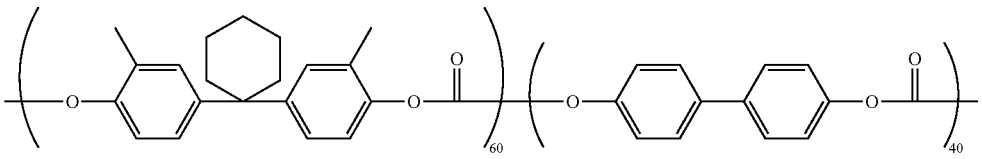

(PC-2)

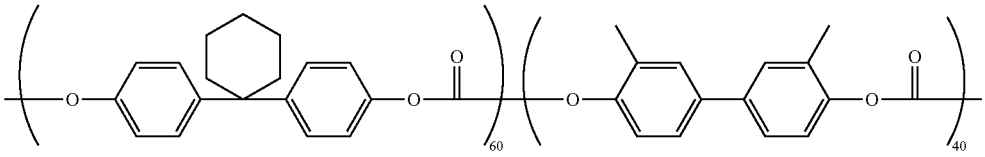

No particular limitations are placed on a sequence of the repeating units (20) and (21) in the polycarbonate resin (PC). That is, the polycarbonate resin (PC) may be any of a random copolymer, an alternating copolymer, a periodic copolymer, and a block copolymer.

The polycarbonate resin (PC) may have only the repeating units (20) and (21) as repeating units. Alternatively, the polycarbonate resin (PC) may further have, in addition to the repeating units (20) and (21), a repeating unit other than the repeating units (20) and (21).

In a case where the binder resin is the polycarbonate resin (PC), the polycarbonate resin (PC) has a viscosity average molecular weight preferably of at least 20,000, more preferably of at least 25,000, and further preferably of at least 30,000.

The polycarbonate resin (PC) has a viscosity average molecular weight preferably of no greater than 70,000, more preferably of no greater than 50,000, and still more preferably of no greater than 40,000. As a result of the polycarbonate resin (PC) having a viscosity average molecular weight of at least 20,000, abrasion of the photosensitive layer hardly occurs. On the other hand, as a result of the polycarbonate resin (PC) having a viscosity average molecular weight of no greater than 70,000, the polycarbonate resin (PC) is easy to dissolve in a solvent. Thus, formation of the photosensitive layer can be facilitated.

Examples of a production method of the polycarbonate resin include interfacial condensation polymerization of a diol compound and phosgene (known as phosgene method) and transesterification of a diol compound and diphenyl carbonate. Specific examples of the diol compound used in the phosgene method include compounds represented by general formulas (20A) and (21A) shown below. $Q^1$, $Q^2$, $Q^3$ and $Q^4$ in general formulas (20A) and (21A) are defined the same as $Q^1$, $Q^2$, $Q^3$ and $Q^4$ in general formulas (20) and (21), respectively. The ratio n can be changed by changing the amount of the compound represented by general formula (20A) relative to the addition amount of the compound represented by general formula (21A).

(20A)

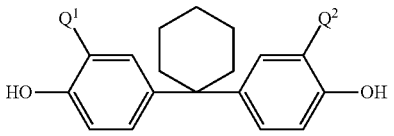

(21A)

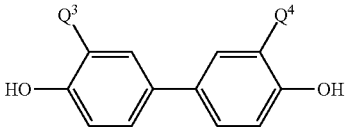

The photosensitive layer may contain only one polyarylate resin (PA) or two or more polyarylate resins (PA) as the binder resin. The photosensitive layer may contain one or more polyarylate resins (PA) only as the binder resin. The photosensitive layer may contain only one polycarbonate resin (PC) or two or more polycarbonate resins (PC) as the binder resin. The photosensitive layer may contain one or more polycarbonate resins (PC) only as the binder resin. The photosensitive layer may further contain a binder resin other than the polyarylate resins (PA) and polycarbonate resin (PC) (also referred to below as an additional binder resin) in addition to either or both the polyarylate resins (PA) and polycarbonate resin (PC).

Examples of the additional binder resin include thermoplastic resins (more specifically, polycarbonate resins other than the polycarbonate resin (PC), polyarylate resins other than the polyarylate resin (PA), styrene-based resins, styrene-butadiene copolymers, styrene-acrylonitrile copolymers, styrene-maleate copolymers, styrene-acrylate copolymers, acrylic copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, polyester resins, alkyd resins, polyamide resins, polyurethane resins, polysulfone resins, diallyl phthalate resins, ketone resins, polyvinyl butyral resins, and polyether resins), thermosetting resins (more specifically, silicone resins, epoxy resins, phenolic resins, urea resins, melamine resins, and other cross-linkable thermosetting resins), and photocurable resins (more specifically, epoxy-acrylic acid-based resins and urethane-acrylic acid-based copolymers).

(Base Resin)

When the photosensitive member is a multi-layer photosensitive member, the charge generating layer contains a base resin. Examples of the binder resin include thermoplastic resins (more specifically, polycarbonate resins, polyarylate resins, styrene-based resins, styrene-butadiene copolymers, styrene-acrylonitrile copolymers, styrene-maleate copolymers, styrene-acrylate copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, polyester resins, alkyd resins, polyamide resins, polyurethane resins, polysulfone resins, diallyl phthalate resins, ketone resins, polyvinyl butyral resins, and polyether resins), thermosetting resins (more specifically, silicone resins, epoxy resins, phenolic resins, urea resins, melamine resins, and other cross-linkable thermosetting resins), and photocurable resins (more specifically, epoxy-acrylic acid-based resins and urethane-acrylic acid-based copolymers). The charge generating layer may contain only one of these base resins or two or more thereof. In order to favorably form the charge generating layer and the charge transport layer, the base resin contained in the charge generating layer is preferably different from the binder resin contained in the charge transport layer.

(Electron Transport Material)

When the photosensitive member is a single-layer photosensitive member, the single-layer photosensitive layer preferably contains an electron transport material. Examples of the electron transport material include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of the quinone-based compounds include diphenoquinone-based compounds, azoquinone-based compounds, anthraquinone-based compounds, naphthoquinone-based compounds, nitroanthraquinone-based compounds, and dinitroanthraquinone-based compounds. The single-layer photosensitive layer may contain only one electron transport material or two or more electron transport materials.

In order to improve charging stability of the single-layer photosensitive member and inhibit crystallization of the single-layer photosensitive layer, the electron transport material preferably includes a compound represented by general formula (30), (31), or (32). The compounds represented by general formulas (30), (31), and (32) are referred to below as compounds (30), (31), and (32), respectively. That is, the single-layer photosensitive layer preferably contains the compound (30), (31), or (32) as the electron transport material.

(30)

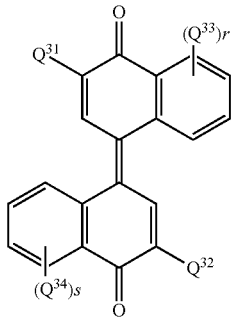

(31)

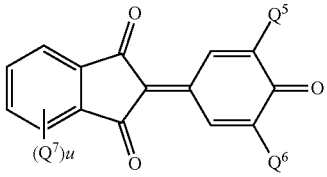

(32)

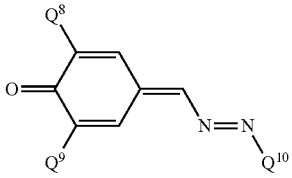

In general formula (30), $Q^{31}$ and $Q^{32}$ each represent, independently of each other, a hydrogen atom, an alkyl group having a carbon number of at least 1 and no greater than 8, a phenyl group, or an alkoxy group having a carbon number of at least 1 and no greater than 8, $Q^{33}$ and $Q^{34}$ each represent, independently of each other, an alkyl group having a carbon number of at least 1 and no greater than 8, a phenyl group, or an alkoxy group having a carbon number of at least 1 and no greater than 8. r and s each represent, independently of each other, an integer of at least 0 and no greater than 4.

In general formula (30), when r represents an integer of at least 2 and no greater than 4, groups represented by $Q^{33}$ may be the same as or different from each other. When s represents an integer of at least 2 and no greater than 4, groups represented by $Q^{34}$ may be the same as or different from each other.

In general formula (30), $Q^{31}$ and $Q^{32}$ each represent, independently of each other, preferably an alkyl group having a carbon number of at least 1 and no greater than 8, more preferably an alkyl group having a carbon number of at least 1 and no greater than 6, still more preferably an alkyl group having a carbon number of 5, and particularly preferably a 1,1-dimethylpropyl group. r and s preferably each represent 0.

In general formula (31), $Q^5$ and $Q^6$ each represent, independently of each other, a hydrogen atom, an alkyl group having a carbon number of at least 1 and no greater than 8, a phenyl group, or an alkoxy group having a carbon number of at least 1 and no greater than 8, $Q^7$ represent an alkyl group having a carbon number of at least 1 and no greater than 8, a phenyl group, or an alkoxy group having a carbon number of at least 1 and no greater than 8, u represents an integer of at least 0 and no greater than 4.

In general formula (31), when u represents an integer of at least 2 and no greater than 4, groups represented by $Q^7$ may be the same as or different from each other.

In general formula (31), $Q^5$ and $Q^6$ each represent, independently of each other, preferably an alkyl group having a carbon number of at least 1 and no greater than 8, more preferably an alkyl group having a carbon number of at least 1 and no greater than 6, still more preferably an alkyl group having a carbon number of 4, and particularly preferably a tert-butyl group. u preferably represents 0.

In general formula (32), $Q^8$ and $Q^9$ each represent, independently of each other, a hydrogen atom or an alkyl group having a carbon number of at least 1 and no greater than 6, $Q^{10}$ represents an aryl group having a carbon number of at least 6 and no greater than 14 and being optionally substituted with a halogen atom.

In general formula (32), $Q^8$ and $Q^9$ each represent, independently of each other, preferably an alkyl group having a carbon number of at least 1 and no greater than 6, more preferably an alkyl group having a carbon number of 4, and particularly preferably a tert-butyl group, $Q^{10}$ represents preferably an alkyl group having a carbon number of at least 6 and no greater than 14 and being substituted with a halogen atom, more preferably a phenyl group substituted with a halogen atom, still more preferably a chlorophenyl group, and particularly preferably a 4-chlorophenyl group.

More preferable examples of the electron transport material to improve charging stability of the single-layer photosensitive member and inhibit crystallization of the single-layer photosensitive layer include compounds represented by chemical formulas (E-1), (E-2), and (E-3) (also referred to below as compounds (E-1), (E-2), and (E-3), respectively). A preferable example of the compound (30) is the compound (E-1). A preferable example of the compound (31) is the compound (E-2). A preferable example of the compound (32) is the compound (E-3).

(E-1)

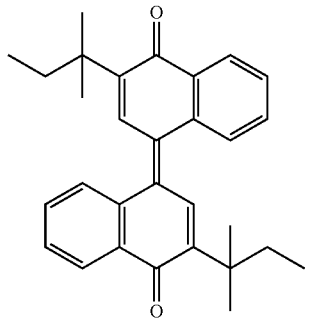

(E-2)

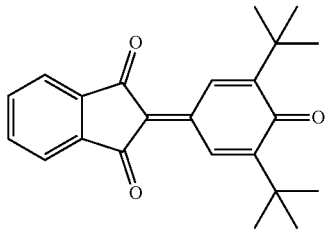

-continued (E-3)

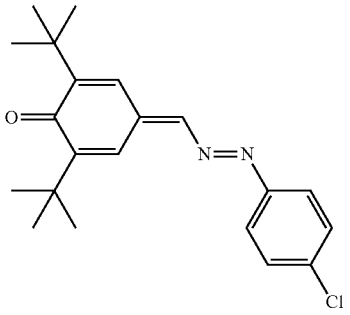

The amount of the electron transport material is preferably at least 5 parts by mass and no greater than 150 parts by mass relative to 100 parts by mass of the binder resin, more preferably at least 10 parts by mass and no greater than 50 parts by mass, and more preferably at least 20 parts by mass and no greater than 40 parts by mass.

The content percentage of the electron transport material relative to the mass of the single-layer photosensitive layer is preferably at least 18.0% by mass and no greater than 30.0% by mass, more preferably at least 23.0% by mass and no greater than 30.0% by mass, and still more preferably at least 25.0% by mass and no greater than 30.0% by mass. As a result of the content percentage of the electron transport material relative to the mass of the single-layer photosensitive layer being at least 18.0% by mass, charging stability of the single-layer photosensitive member is further improved. As a result of the content percentage of the electron transport material relative to the mass of the single-layer photosensitive layer being no greater than 30.0% by mass, crystallization of the single-layer photosensitive layer can be further inhibited.

The single-layer photosensitive layer may contain only one electron transport material or two or more electron transport materials. The single-layer photosensitive layer may contain the compound (30), (31), or (32) only as the electron transport material. Alternatively, the single-layer photosensitive layer may further contain, in addition to the compound (30), (31), or (32), an additional electron transport material other than these.

(Additive)

Examples of additives include antioxidants, radical scavengers, singlet quenchers, ultraviolet absorbing agents, softeners, surface modifiers, extenders, thickeners, dispersion stabilizers, waxes, donors, surfactants, plasticizers, sensitizers, electron acceptor compounds, and leveling agents.

(Combination of Materials)

In order to improve charging stability of the photosensitive member and inhibit crystallization of the photosensitive layer, a combination of the hole transport material and the binder resin is preferably any of combination examples B1 to B12 in Table 1. For the same reasons, it is more preferable that the combination of the hole transport material and the binder resin is any of the combination examples B1 to B12 in Table 1 and the charge generating material is Y-form titanyl phthalocyanine.

In Table 1 and Tables 2 to 4 described later, "Example" represents "combination example", "HTM" represents "hole transport material", "ETM" represents "electron transport material", and "Resin" represents "binder resin"

TABLE 1

| Example | HTM | Resin |
|---|---|---|
| B1 | 1-1 | First polyarylate resin |
| B2 | 1-1 | Second polyarylate resin |
| B3 | 1-1 | R-1 |
| B4 | 1-1 | R-2 |
| B5 | 1-2 | First polyarylate resin |
| B6 | 1-2 | Second polyarylate resin |
| B7 | 1-2 | R-1 |
| B8 | 1-2 | R-2 |
| B9 | 1-3 | First polyarylate resin |
| B10 | 1-3 | Second polyarylate resin |
| B11 | 1-3 | R-1 |
| B12 | 1-3 | R-2 |

In order to improve charging stability of the photosensitive member and inhibit crystallization of the photosensitive layer, a combination of the hole transport material and the electron transport material is preferably any of combination examples C1 to C9 in Table 2. For the same reasons, it is more preferable that the combination of the hole transport material and the electron transport material is any of the combination examples C1 to C9 in Table 2 and the charge generating material is Y-form titanyl phthalocyanine.

TABLE 2

| Example | HTM | ETM |
|---|---|---|
| C1 | 1-1 | E-1 |
| C2 | 1-1 | E-2 |
| C3 | 1-1 | E-3 |
| C4 | 1-2 | E-1 |
| C5 | 1-2 | E-2 |
| C6 | 1-2 | E-3 |
| C7 | 1-3 | E-1 |
| C8 | 1-3 | E-2 |
| C9 | 1-3 | E-3 |

In order to improve charging stability of the photosensitive member and inhibit crystallization of the photosensitive layer, a combination of the hole transport material, the electron transport material, and the binder resin is preferably any of combination examples D1 to D36 in Table 3. For the same reasons, it is more preferable that the combination of the hole transport material, the electron transport material, and the binder resin is any of the combination examples D1 to D36 in Table 3 and the charge generating material is Y-form titanyl phthalocyanine.

TABLE 3

| Example | HTM | ETM | Resin |
|---|---|---|---|
| D1 | 1-1 | E-1 | First polyarylate resin |
| D2 | 1-1 | E-1 | Second polyarylate resin |
| D3 | 1-1 | E-2 | First polyarylate resin |
| D4 | 1-1 | E-2 | Second polyarylate resin |
| D5 | 1-1 | E-3 | First polyarylate resin |
| D6 | 1-1 | E-3 | Second polyarylate resin |
| D7 | 1-2 | E-1 | First polyarylate resin |
| D8 | 1-2 | E-1 | Second polyarylate resin |
| D9 | 1-2 | E-2 | First polyarylate resin |
| D10 | 1-2 | E-2 | Second polyarylate resin |
| D11 | 1-2 | E-3 | First polyarylate resin |
| D12 | 1-2 | E-3 | Second polyarylate resin |
| D13 | 1-3 | E-1 | First polyarylate resin |
| D14 | 1-3 | E-1 | Second polyarylate resin |
| D15 | 1-3 | E-2 | First polyarylate resin |
| D16 | 1-3 | E-2 | Second polyarylate resin |
| D17 | 1-3 | E-3 | First polyarylate resin |
| D18 | 1-3 | E-3 | Second polyarylate resin |

TABLE 3-continued

| Example | HTM | ETM | Resin |
|---|---|---|---|
| D19 | 1-1 | E-1 | R-1 |
| D20 | 1-1 | E-1 | R-2 |
| D21 | 1-1 | E-2 | R-1 |
| D22 | 1-1 | E-2 | R-2 |
| D23 | 1-1 | E-3 | R-1 |
| D24 | 1-1 | E-3 | R-2 |
| D25 | 1-2 | E-1 | R-1 |
| D26 | 1-2 | E-1 | R-2 |
| D27 | 1-2 | E-2 | R-1 |
| D28 | 1-2 | E-2 | R-2 |
| D29 | 1-2 | E-3 | R-1 |
| D30 | 1-2 | E-3 | R-2 |
| D31 | 1-3 | E-1 | R-1 |
| D32 | 1-3 | E-1 | R-2 |
| D33 | 1-3 | E-2 | R-1 |
| D34 | 1-3 | E-2 | R-2 |
| D35 | 1-3 | E-3 | R-1 |
| D36 | 1-3 | E-3 | R-2 |

In order to improve charging stability of the photosensitive member and inhibit crystallization of the photosensitive layer, it is also preferable that a combination of the hole transport material and the binder resin is any of combination examples No. 1 to No. 12 in Table 4. For the same reasons, it is preferable that the combination of the hole transport material and the binder resin is any of the combination examples No. 1 to No. 12 in Table 4 and the electron transport material is the compound (E-1). For the same reasons, it is preferable that the combination of the hole transport material and the binder resin is any of the combination examples No. 1 to No. 12 in Table 4 and the charge generating material is Y-form titanyl phthalocyanine. For the same reasons, it is preferable that the combination of the hole transport material and the binder resin is any of the combination examples No. 1 to No. 12 in Table 4, the electron transport material is the compound (E-1), and the charge generating material is Y-form titanyl phthalocyanine.

TABLE 4

| Example | HTM | Resin |
|---|---|---|
| No. 1 | 1-1 | First polyarylate resin |
| No. 2 | 1-1 | Second polyarylate resin |
| No. 3 | 1-2 | First polyarylate resin |
| No. 4 | 1-2 | Second polyarylate resin |
| No. 5 | 1-3 | First polyarylate resin |
| No. 6 | 1-3 | Second polyarylate resin |
| No. 7 | 1-1 | PC-1 |
| No. 8 | 1-1 | PC-2 |
| No. 9 | 1-2 | PC-1 |
| No. 10 | 1-2 | PC-2 |
| No. 11 | 1-3 | PC-1 |
| No. 12 | 1-3 | PC-2 |

(Conductive Substrate)

No particular limitations are placed on the conductive substrate as long as the conductive substrate can be used in the photosensitive member. It is only required that at least a surface portion of the conductive substrate is formed from a conductive material. An example of the conductive substrate is a conductive substrate formed from a conductive material. Another example of the conductive substrate is a conductive substrate covered with a conductive material. Examples of conductive materials include aluminum, iron, copper, tin, platinum, silver, vanadium, molybdenum chromium, cadmium, titanium, nickel, palladium, indium, stainless steel, and brass. Any one of the conductive materials listed above may be used independently, or any two or more of the conductive materials listed above may be used in combination (for example as an alloy). Among the conductive materials listed above, aluminum or an aluminum alloy is preferable in terms of favorable charge mobility from the photosensitive layer to the conductive substrate.

The shape of the conductive substrate can be selected appropriately according to a configuration of an image forming apparatus in which the conductive substrate is to be used. The conductive substrate is for example in a sheet shape or a drum shape. The thickness of the conductive substrate is appropriately selected according to the shape of the conductive substrate.

(Intermediate Layer)

The intermediate layer (undercoat layer) for example contains inorganic particles and a resin for intermediate layer use (intermediate layer resin). Provision of the intermediate layer can facilitate flow of current generated when the photosensitive member is exposed to light and inhibit increasing resistance, while also maintaining insulation to a sufficient degree so as to inhibit occurrence of leakage current.

Examples of inorganic particles include particles of metals (examples include aluminum, iron, and copper), particles of metal oxides (examples include titanium oxide, alumina, zirconium oxide, tin oxide, and zinc oxide), and particles of non-metal oxides (for example silica). Any one type of inorganic particles listed above may be used independently, or any two or more types of organic particles listed above may be used in combination.

Examples of the intermediate layer resin are the same as those of the base resin described above. To favorably form the intermediate layer and the photosensitive layer, the intermediate layer resin is preferably different from the base resin and the binder resin contained in the photosensitive layer. The intermediate layer may contain an additive. Examples of the additive that may be contained in the intermediate layer are the same as those of the additive that may be contained in the photosensitive layer.

(Photosensitive Member Production Method)

The following describes an example of a single-layer photosensitive member production method and an example of a multi-layer photosensitive member production method as examples of a photosensitive member production method.

The single-layer photosensitive member production method includes single-layer photosensitive layer formation. In the single-layer photosensitive layer formation, an application liquid for forming a single-layer photosensitive layer (also referred to below as an application liquid for single-layer photosensitive layer formation) is prepared. The application liquid for single-layer photosensitive layer formation is applied onto a conductive substrate. Next, at least a portion of a solvent contained in the applied application liquid for photosensitive layer formation is removed to form a single-layer photosensitive layer. The application liquid for single-layer photosensitive layer formation contains for example a charge generating material, a hole transport material, a binder resin, and the solvent. The application liquid for single-layer photosensitive layer formation is prepared by dissolving or dispersing in the solvent the charge generating material, the hole transport material, and the binder resin. The application liquid for single-layer photosensitive layer formation may further contain an electron transport material. The application liquid for single-layer photosensitive layer formation may further contain an additive as necessary.

The multi-layer photosensitive member production method includes charge generating layer formation and charge transport layer formation. In the charge generating layer formation, an application liquid for forming a charge generating layer (also referred to below as an application liquid for charge generating layer formation) is prepared first. The application liquid for charge generating layer formation is applied onto a conductive substrate. Next, at least a portion of a solvent contained in the applied application liquid for charge generating layer formation is removed to form a charge generating layer. The application liquid for charge generating layer formation contains for example a charge generating material, a base resin, and the solvent. The application liquid for charge generating layer formation is prepared by dissolving or dispersing in the solvent the charge generating material and the base resin. The application liquid for charge generating layer formation may further contain an additive as necessary.

In the charge transport layer formation, an application liquid for forming a charge transport layer (also referred to below as an application liquid for charge transport layer formation) is prepared first. The application liquid for charge transport layer formation is applied onto the charge generating layer. Next, at least a portion of a solvent contained in the applied application liquid for charge transport layer formation is removed to form a charge transport layer. The application liquid for charge transport layer formation contains for example a hole transport material, a binder resin, and the solvent. The application liquid for charge transport layer formation is prepared by dissolving or dispersing in the solvent the hole transport material and the binder resin. The application liquid for charge transport layer formation may further contain an additive as necessary.

No particular limitations are placed on the respective solvents contained in the application liquid for single-layer photosensitive layer formation, the application liquid for charge generating layer formation, and the application liquid for charge transport layer formation (also referred to below collectively as application liquids) as long as components of the application liquids for photosensitive layer formation are soluble or dispersible in the respective solvents. Examples of the solvents include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Any one of the solvents listed above may be used independently, or any two or more of the solvents listed above may be used in combination.

The solvent contained in the application liquid for charge transport layer formation is preferably different from the solvent contained in the application liquid for charge generating layer formation. The reason therefor is that it is preferable that the charge generating layer does not dissolve in the solvent of the application liquid for charge transport layer formation in applicatno of the application liquid for charge transport layer on the charge generating layer.

The application liquids are prepared by mixing the components to disperse the components in the respective solvents. Mixing or dispersion can for example be performed using a bead mill, a roll mill, a ball mill, an attritor, a paint shaker, or an ultrasonic disperser.

The method for applying the application liquids is not particularly limited as long as the application liquids can uniformly be applied. Examples of the application method include dip coating, spray coating, spin coating, and bar coating.

The method for removing at least a portion of the solvent contained in each applied application liquid may be for example heating, pressure reduction, or combinational use of heating and pressure reduction. More specifically, the method may for example be heat treatment (hot-air drying) using a high-temperature dryer or a reduced pressure dryer. The temperature of the heat treatment is for example 40° C. or higher and 150° C. or lower. Heat treatment time is for example 3 minutes or longer and 120 minutes or shorter.

Note that the photosensitive member production method may further include intermediate layer formation as necessary. A known method may be selected as appropriate for the intermediate layer formation.

<Image Forming Apparatus>

Figure 7:
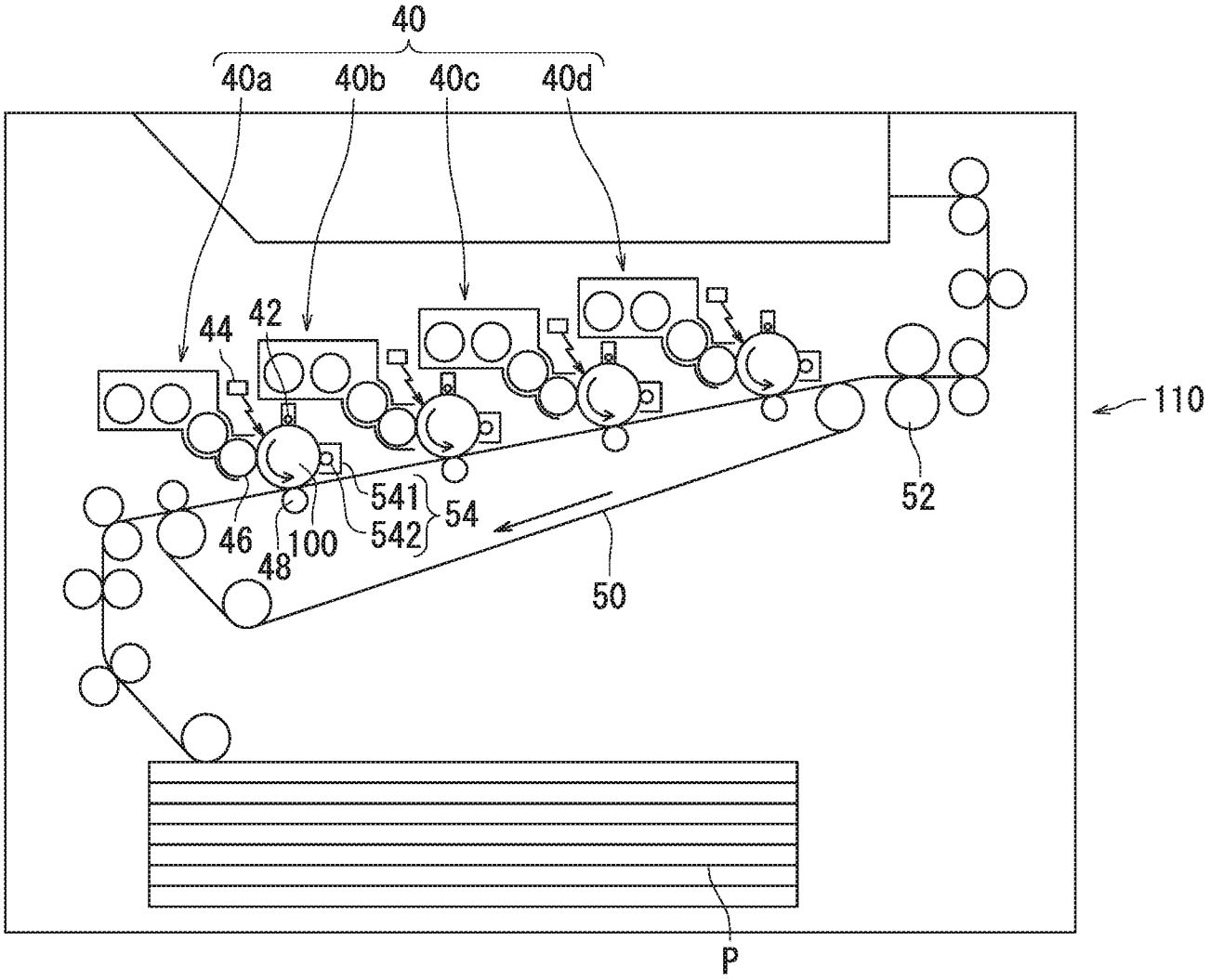
FIG. 7 is a cross sectional view of an example of an image forming apparatus.

The following describes an image forming apparatus including the photosensitive member according to the present embodiment. The following describes the image forming apparatus through use of an example of a tandem color image forming apparatus with reference to FIG. 7. FIG. 7 is a cross sectional view of an example of the image forming apparatus.

An image forming apparatus 110 illustrated in FIG. 7 includes image forming units 40*a*, 40*b*, 40*c*, and 40*d*, a transfer belt 50, and a fixing device 52. Hereinafter, each of the image forming units 40*a*, 40*b*, 40*c*, and 40*d* is referred to as an image forming unit 40 where it is not necessary to distinguish among the image forming units 40*a*, 40*b*. 40*c*, and 40*d*.

The image forming unit 40 includes an image bearing member 100, a charger 42, a light exposure device 44, a developing device 46, a transfer device 48, and a cleaner 54. The image bearing member 100 is the photosensitive member (more specifically, the single-layer photosensitive member 1 or multi-layer photosensitive member 10) according to the present embodiment.

As already described, the photosensitive member (more specifically, the single-layer photosensitive member 1 or multi-layer photosensitive member 10) according to the present embodiment can have improved charging stability and inhibit crystallization of the photosensitive layer 3. Therefore, when provided with the photosensitive member as the image bearing member 100, the image forming apparatus 110 can form a favorable image on a recording medium P.

The image bearing member 100 is disposed at a central position in the image forming unit 40. The image bearing member 100 is rotatable in a direction indicated by an arrow (counterclockwise direction) in FIG. 7. Around the image bearing member 100, the charger 42, the light exposure device 44, the developing device 46, the transfer device 48, and the cleaner 54 are disposed in the stated order from upstream in a rotation direction of the image bearing member 100.

Toner images in different colors (for example four colors of black, cyan, magenta, and yellow) are sequentially superimposed on the recording medium P placed on the transfer belt 50 by the respective image forming units 40*a* to 40*d*.

The charger 42 charges a surface (for example a circumferential surface) of the image bearing member 100. The charger 42 is for example a scorotron charger.

The light exposure device 44 irradiates the charged surface of the image bearing member 100. As a result, an electrostatic latent image is formed on the surface of the image bearing member 100. The electrostatic latent image is formed based on image data input to the image forming apparatus 110.

The developing device 46 supplies toner to the surface of the image bearing member 100 to develop the electrostatic latent image into a toner image. The developing device 46 develops the electrostatic latent image into a toner image while in contact with the surface of the image bearing member 100. That is, the image forming apparatus 110 employs a contact developing process. The developing device 46 is for example a developing roller. In a case using a one-component developer as a developer, the developing device 46 supplies a toner that is the one-component developer to the electrostatic latent image formed on the surface of the image bearing member 100. In a case using a two-component developer as the developer, the developing device 46 supplies a toner of the two-component developer including the toner and a carrier to the electrostatic latent image formed on the surface of the image bearing member 100. In this way, the image bearing member 100 bears a toner image.

The transfer belt 50 conveys the recording medium P between the image bearing member 100 and the transfer device 48. The transfer belt 50 is an endless belt. The transfer belt 50 is rotatable in a direction indicated by an arrow (clockwise direction) in FIG. 7.

The transfer device 48 transfers the toner image developed by the developing device 46 from the surface of the image bearing member 100 to the recording medium P that is a transfer target. Specifically, the transfer device 48 transfers the toner image from the surface of the image bearing member 100 to the recording medium P in a state where the surface of the image bearing member 100 and the recording medium P are in contact with each other. That is, the image forming apparatus 110 employs a direct transfer process. The transfer device 48 is for example a transfer roller.

The cleaner 54 collects toner adhering to the surface of the image bearing member 100. The cleaner 54 includes a housing 541 and a cleaning roller 542. The cleaner 54 does not include a cleaning blade. The cleaning roller 542 is disposed in the housing 541. The cleaning roller 542 is in contact with the surface of the image bearing member 100. The cleaning roller 542 polishes the surface of the image bearing member 100 to collect toner adhering to the surface of the image bearing member 100 into the housing 541.

The recording medium P having thereon the toner image transferred by the transfer device 48 is conveyed to the fixing device 52 by the transfer belt 50. The fixing device 52 includes for example either or both a heating roller and a pressure roller. Either or both heat and pressure are applied by the fixing device 52 to toner image transferred by the transfer device 48 and unfixed yet. As a result of application of either or both heat and pressure, the toner image is fixed onto the recording medium P. Through the above, an image is formed on the recording medium P.

Although an example of the image forming apparatus has been described so far, the image forming apparatus is not limited to the above-described image forming apparatus 110. The above-described image forming apparatus 110 is a color image forming apparatus, but the image forming apparatus may be a monochrome image forming apparatus. In a case of a monochrome image forming apparatus, the image forming apparatus may include only one image forming unit for example. The above-described image forming apparatus 110 is a tandem image forming apparatus, but the image forming apparatus may be for example a rotary image forming apparatus. Although the charger 42 has been described using a scorotron charger as an example thereof, the charger may be a charger other than the scorotron charger (for example a charging roller, a charging brush, or a corotron charger). The above-described image forming apparatus 110 employs a contact developing process, but the image forming apparatus may employ for example a non-contact developing process. The above-described image forming apparatus 110 employs a direct transfer process, but the image forming apparatus may employ an intermediate transfer process. When the image forming apparatus employs an intermediate transfer process, the transfer target corresponds to an intermediate transfer belt. The above-described cleaner 54 includes the cleaning roller 542 and does not include the cleaning blade, but the cleaner 54 may include a cleaning roller 542 and a cleaning blade. The above-described image forming unit 40 does not include a static eliminator, but the image forming unit may further include a static eliminator.

<Process Cartridge>

The following describes an example of a process cartridge including the photosensitive member (more specifically, the single-layer photosensitive member 1 or multi-layer photosensitive member 10) of the present embodiment with further reference to FIG. 7. The process cartridge corresponds to each of the image forming units 40*a* to 40*d*. The process cartridge includes the image bearing member 100. The image bearing member 100 is the photosensitive member (more specifically, the single-layer photosensitive member 1 or multi-layer photosensitive member 10) according to the present embodiment. In addition to the image bearing member 100, the process cartridge further includes at least one of the charger 42 and the cleaner 54.

As already described, according to the photosensitive member (more specifically, the single-layer photosensitive member 1 or multi-layer photosensitive member 10) of the present embodiment, it is possible to improve charging stability of the photosensitive member and inhibit the crystallization of the photosensitive layer 3. Therefore, when provided with the photosensitive member as the image bearing member 100, the process cartridge can form a favorable image on a recording medium P.

The process cartridge may further include at least one of the light exposure device 44, the developing device 46, and the transfer device 48, in addition to the image bearing member 100, the charger 42, and the cleaner 54. The process cartridge may further include a static eliminator (not illustrated). The process cartridge may be designed to be freely attachable to and detachable from an image forming apparatus 110. In the above configuration, the process cartridge is easy to handle and can therefore be easily and quickly replaced, together with the photosensitive member 1, when sensitivity characteristics or the like of the photosensitive member 1 degrade. The process cartridge including the photosensitive member according to the present embodiment has been described so far with reference to FIG. 7.

EXAMPLES

The following provides more specific description of the present disclosure through use of Examples. However, the present disclosure is not limited to the scope of Examples.

First, the following charge generating material, electron transport materials, hole transport materials, and binder resins were prepared as materials for forming single-layer photosensitive layers of single-layer photosensitive members.

(Charge Generating Material)

Y-form titanyl phthalocyanine was prepared as a charge generating material.

(Electron Transport Material)

The compounds (E-1) to (E-3) described in association with the embodiment were each prepared as an electron transport material.

(Hole Transport Material)

The compounds (1-1) and (1-3) described in association with the embodiment were each prepared as a hole transport material. The compounds (1-1) and (1-3) were synthesized by the following methods.

(Synthesis of Compound (1-1))

A 500-mL three-necked flask was charged with 4,4"-dibromo-p-terphenyl (11.98 g, 30.9 mmol), palladium(II) acetate (0.069 g, 0.307 mmol), (4-dimethylaminophenyl)di-tert-butylphosphine (0.205 g, 0.772 mmol), and sodium tert-butoxide (7.702 g, 80.15 mmol). The air in the flask was replaced with nitrogen gas by repetition of degasification in the flask and nitrogen gas replacement twice. Subsequently, the flask was charged with (2,4-dimethylphenyl)(4'-methylphenyl)amine (13.85 g, 63.3 mmol) and xylene (100 mL). The flask contents were stirred under reflux at 120° C. for 3 hours. Next, the temperature of the flask contents was lowered to 50° C. The flask contents were filtered to remove ash, and a filtrate was obtained. To the filtrate, activated clay ("SA-1", product of Nippon Activated Clay Co., Ltd., 24 g) was added and stirred at 80° C. for 10 minutes to give a mixture. The mixture was filtered to give a filtrate. Xylene in the filtrate was evaporated off under reduced pressure to give a residue. To the residue, 20 g of toluene was added and heated to 100° C. By the heating, the residue was dissolved in the toluene to give a solution. To the solution, n-hexane was added until the solution became slightly cloudy. Next, the solution was cooled to 5° C., and precipitated crystals were separated by filtration. The obtained crystals were dried, and thus the compound (1-1) was obtained. The mass yield of the compound (1-1) was 18.2 g. The percent yield of the compound (1-1) from 4,4"-dibromo-p-terphenyl was 90.8 mol %.

(Synthesis of Compound (1-2))

The compound (1-2) was obtained by the same method as the above synthesis of the compound (1-1) in all aspects except that 63.3 mmol of (2,4-dimethylphenyl)(4'-methylphenyl)amine was changed to 63.3 mmol of (2-ethylphenyl)(4'-methylphenyl)amine.

(Synthesis of Compound (1-3)

The compound (1-3) was obtained by the same method as the above synthesis of the compound (1-1) in all aspects except that 63.3 mmol of (2,4-dimethylphenyl)(4'-methylphenyl)amine was changed to 63.3 mmol of (4-ethylphenyl)(4'-methylphenyl)amine.

A $^1$H-NMR spectrum of each synthesized compound (1-1) to (1-3) was plotted using a proton nuclear magnetic resonance pectrometer (product of JASCO Corporation, 300 MHz). $CDCl_3$ was used as a solvent. Tetramethylsilane (TMS) was used as an internal standard sample. Chemical shift values of the compound (1-1) as a representative example of the compounds (1-1) to (1-3) are shown below. It was confirmed from chemical shift values that the compound (1-1) was obtained. It was also confirmed by the same method that the compounds (1-2) and (1-3) were obtained.

Compound (1-1): $^1$H-NMR (300 MHz, $CDCl_3$) δ=7.57 (s, 4H), 7.42-7.45 (m, 4H), 7.01-7.07 (m, 18H), 2.34 (s, 6H), 2.29 (s, 6H), 2.03 (s, 6H).

Next, compounds represented by the following chemical formulas (H-4) to (H-14) (also referred to below as compounds (H-4) to (H-14), respectively) were prepared as hole transport materials used in Comparative Examples.

(H-4)

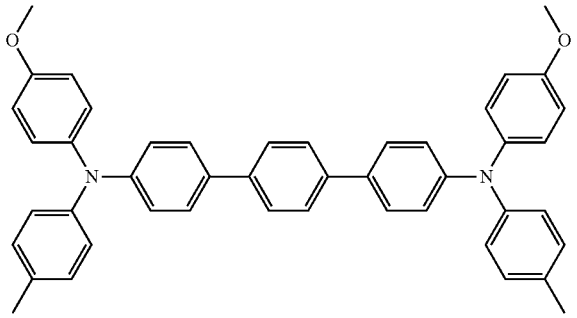

(H-5)

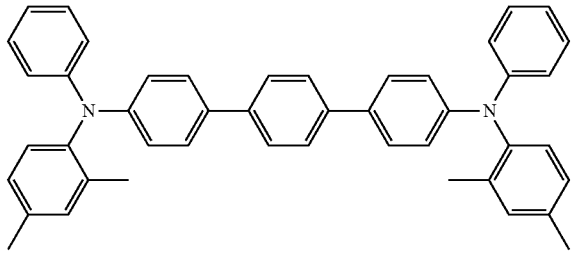

(H-6)

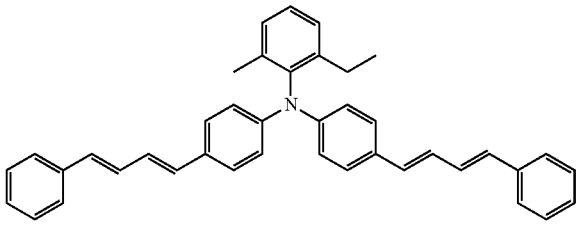

(H-7)

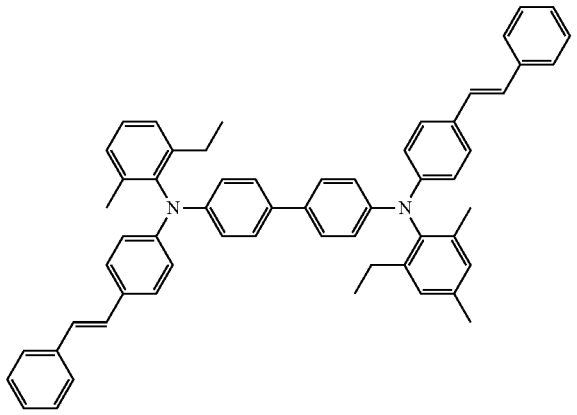

-continued (H-8)

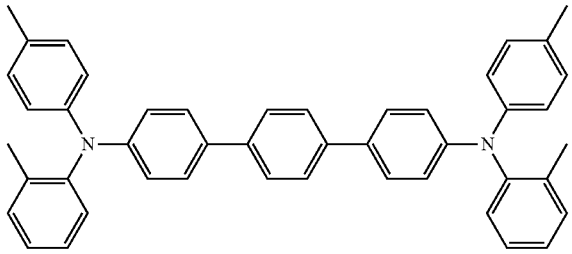

(H-9)

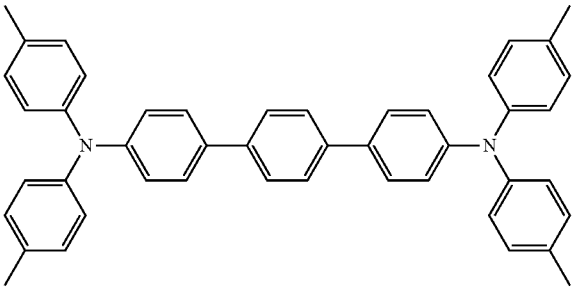

(H-10)

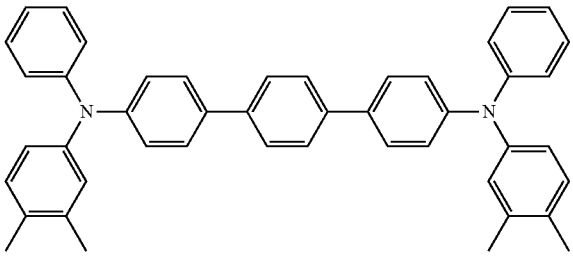

(H-11)

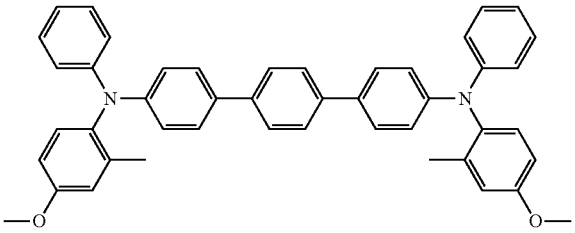

(H-12)

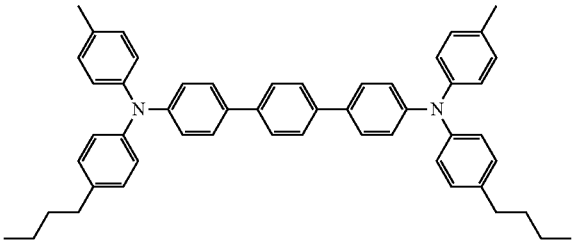

-continued (H-13)

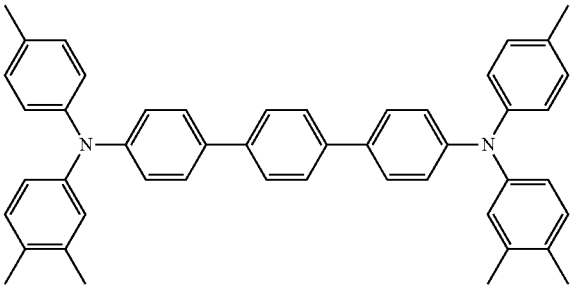

(H-14)

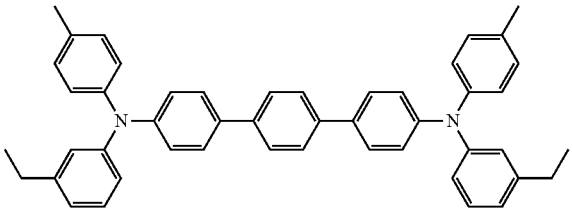

(Binder Resin: Polyarylate Resin)

The polyarylate resins (R-1) and (R-2) described above in association with the embodiment were prepared as binder resins. The polyarylate resins (R-1) and (R-2) were each synthesized by the following methods.

(Polyarylate Resin (R-1))

A 1-L three-necked flask equipped with a thermometer, a three-way cock, and a 200-mL dropping funnel was used as a reaction vessel. The reaction vessel was charged with 41.2 mmol of the compound (BP-10-1), 0.062 g (0.413 mmol) of tert-butylphenol, 3.92 g (98 mmol) of sodium hydroxide, and 0.120 g (0.384 mmol) of benzyltributylammonium chloride. The air in the reaction vessel was replaced with argon gas. The reaction vessel was further charged with 300 mL of water. The reaction vessel contents were stirred at 50° C. for 1 hour. Next, the resultant reaction vessel contents were cooled to 10° C. to obtain an alkaline aqueous solution A.

In 150 mL of chloroform, 16.2 mmol of dichloride of the compound (DC-11-1) and 16.2 mmol of dichloride of the compound (DC-11-2) were dissolved. Through the above, a chloroform solution B was obtained.

From the dropping funnel, the chloroform solution B was slowly added dropwise to the alkaline aqueous solution A over 110 minutes. The resultant reaction vessel contents were stirred for 4 hours under adjustment of the temperature (liquid temperature) of the vessel contents to 15° C.±5° C. to cause polymerization reaction to proceed. Next, an upper layer (water layer) of the reaction vessel contents was removed by decantation to obtain an organic layer. Next, 400 mL of ion exchanged water was added into a 1-L conical flask. The organic layer obtained as above was added into the flask. To the flask contents, 400 mL of chloroform and 2 mL of acetic acid were further added. Subsequently, the resultant flask contents were stirred at room temperature (25° C.) for 30 minutes. Thereafter, an upper layer (water layer) of the reaction vessel contents was removed by decantation to obtain an organic layer. The organic layer obtained as above was washed with 1 L of ion exchanged water using a separatory funnel. The above washing with ion exchanged water was repeated 5 times to obtain a washed organic layer.

Subsequently, the washed organic layer was filtered to obtain a filtrate. Into a 1-L beaker, 1 L of methanol was added. The filtrate obtained as above was gradually dripped into the methanol in the beaker to obtain a precipitate. The precipitate was collected by filtration. The collected precipitate was vacuum-dried at a temperature of 70° C. for 12 hours. Through the above, the polyarylate resin (R-1) was obtained. The polyarylate resin (R-1) had a viscosity average molecular weight of 47,500.

(Polyarylate Resin (R-2))

The polyarylate resin (R-2) was obtained by the same method as that for the polyarylate resin (R-1) in all aspects except that 41.2 mmol of the compound (BP-10-1) was changed to 41.2 mmol of the compound (BP-10-2). The polyarylate resin (R-2) had a viscosity average molecular weight of 52,400.

The polyarylate resin represented by the following chemical formula (R-3) (also referred to below as polyarylate resin (R-3)) was prepared as a binder resin used in Comparative Examples. The polyarylate resin (R-3) had a viscosity average molecular weight of 53,300. The number attached to the lower right of each repeating unit indicates a ratio of the number of corresponding repeating units to the total number of repeating units in the polycarbonate resin (unit: %).

(R-3)

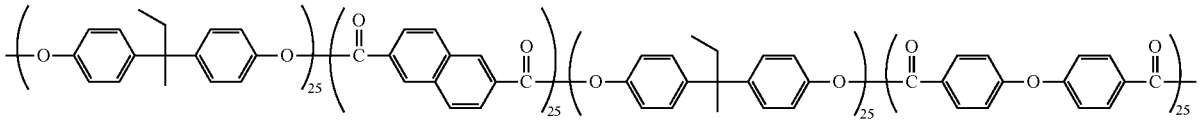

(Binder Resin: Polycarbonate Resin)

The polycarbonate resins (PC-1) and (PC-2) described above in association with the embodiment were prepared as binder resins. The polycarbonate resin (PC-1) had a viscosity average molecular weight of 32,500. The polyarylate resin (PC-2) had a viscosity average molecular weight of 33,300.

The polycarbonate resins represented by the following chemical formulas (PC-3) and (PC-4) (also referred to below as polycarbonate resins (PC-3) and (PC-4), respectively) was prepared as binder resins used in Comparative Examples. The polycarbonate resin (PC-3) had a viscosity average molecular weight of 33,300. The polycarbonate resin (PC-4) had a viscosity average molecular weight of 32,500. In chemical formulas (PC-3) and (PC-4), the number attached to the lower right of each repeating unit indicates a ratio of the number of corresponding repeating units to the total number of repeating units in the polycarbonate resin (unit: %).

(PC-3)

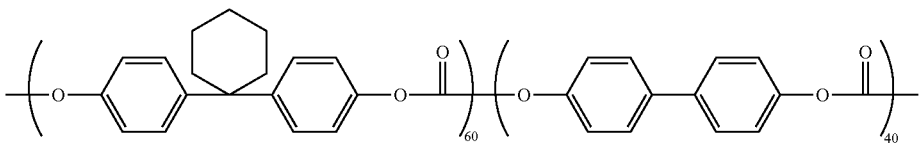

-continued (PC-4)

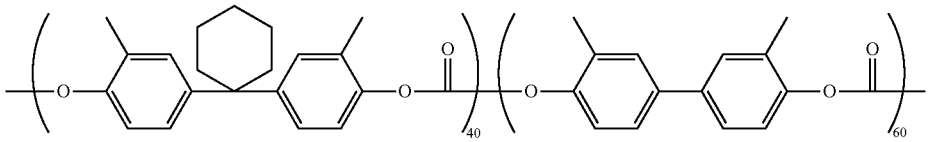

<Production of Single-Layer Photosensitive Members>

Single-layer photosensitive members (A-1) to (A-13), (B-1) to (B-12), (C-1) to (C-4), and (D-1) to (D-13) were produced using the charge generating material, the hole transport materials, the binder resins, and the electron transport materials as described above.

(Production of Single-Layer Photosensitive Member (A-1))

An application liquid for single-layer photosensitive layer formation was obtained by mixing 3 parts by mass of Y-form titanyl phthalocyanine as a charge generating material, 70 parts by mass of the compound (1-1) as a hole transport material, 100 parts by mass of the polyarylate resin (R-1) as a binder resin, 39 parts by mass of the compound (E-1) as an electron transport material, and 800 parts by mass of tetrahydrofuran as a solvent using a ball mill for 50 hours. The application liquid for single-layer photosensitive layer formation was applied onto a conductive substrate (an aluminum drum-shaped support) by dip coating. After the application, the application liquid for single-layer photosensitive layer formation was hot-air dried at 120° C. for 60 minutes. Through the above, a single-layer photosensitive layer (film thickness: 28 μm) was formed on the conductive substrate to produce the photosensitive member (A-1). The single-layer photosensitive member (A-1) had a single-layer photosensitive layer directly on the conductive substrate.

(Production of Single-Layer Photosensitive Members (A-2) to (A-13) and (B-1) to (B-12))

Single-layer photosensitive members (A-2) to (A-13) and (B-1) to (B-12) were produced by the same method as the production method of the single-layer photosensitive member (A-1) in all aspects except that the hole transport materials and the electron transport materials shown in Table 5 were used and that the amounts of the added electron transport materials were changed so that the content percentages of the charge transport materials relative to the mass of the single-layer photosensitive layer resulted in the respective values shown in Table 5.

(Production of Single-Layer Photosensitive Member (C-1))

An application liquid for single-layer photosensitive layer formation was obtained by mixing 3 parts by mass of Y-form titanyl phthalocyanine as a charge generating material, 70 parts by mass of the compound (1-1) as a hole transport material, 100 parts by mass of the polycarbonate resin (PC-1) as a binder resin, 30 parts by mass of the compound (E-1) as an electron transport material, and 800 parts by mass of tetrahydrofuran as a solvent using a ball mill for 50 hours. The application liquid for single-layer photosensitive layer formation was applied onto a conductive substrate (an aluminum drum-shaped support) by dip coating. After the application, the application liquid for single-layer photosensitive layer formation was hot-air dried at 120° C. for 60 minutes. Through the above, a single-layer photosensitive layer (film thickness: 28 μm) was formed on the conductive substrate to produce the photosensitive member (C-1). The single-layer photosensitive member (C-1) had a single-layer photosensitive layer directly on the conductive substrate.

(Production of Single-Layer Photosensitive Members (C-2) to (C-4) and (D-1) to (D-13))

Single-layer photosensitive members (C-2) to (C-4) and (D-1) to (D-13) were produced by the same method as the production method of the single-layer photosensitive member (C-1) in all aspects except that the hole transport materials and the electron transport materials shown in Table 6 were used.

<Evaluation of Sensitivity Characteristics for Single-Layer Photosensitive Members>

Evaluation of sensitivity characteristics was performed on each of the single-layer photosensitive members (A-1) to (A-13), (B-1) to (B-12), (C-1) to (C-4), and (D-1) to (D-13) in an environment at a temperature of 10° C. and a relative humidity of 15%. Specifically, a surface of the single-layer photosensitive member was charged to +750 V using a drum sensitivity test device (product of Gen-Tech. Inc.). Next, monochromatic light (wavelength: 780 nm, light exposure: 0.7 μJ/cm$^2$) was taken out from light of a halogen lamp using a bandpass filter, and the surface of the single-layer photosensitive member was irradiated with the monochromatic light. A surface potential of the photosensitive member was measured when 70 milliseconds elapsed from termination of the monochrome light irradiation. The surface potential measured as above was taken to be a post-exposure potential $V_L$ (unit: +V) of the single-layer photosensitive member. Values for the post-exposure potential $V_L$ of the single-layer photosensitive members are shown in Tables 5 and 6.

<Evaluation of Charging Stability for Single-Layer Photosensitive Members>

Evaluation of charging stability was performed on each of the single-layer photosensitive members (A-1) to (A-13), (B-1) to (B-12), (C-1) to (C-4), and (D-1) to (D-13) in an environment at a temperature of 10° C. and a relative humidity of 15%. For the evaluation of charging stability, an evaluation apparatus (a modified version of a color image forming apparatus "FS-C5250DN", product of KYOCERA Document Solutions Inc.) was used. The evaluation apparatus included a scorotron charger and a cleaning roller, and did not include a cleaning blade. The evaluation apparatus employed a contact developing process using a developing roller, and a direct transfer process. A time from exposure to development was set to 70 milliseconds.

First, an image A (entirely white image) was printed on three recording medium (A4 size paper) sheets using the evaluation apparatus. In printing on each sheet, the surface potential of the single-layer photosensitive member was measured at a position opposite to the developing roller (development position). Since no exposure is performed in printing of a white image, the measured surface potential corresponds to the charge potential. The surface potential was measured once per sheet, 3 times in total. The average value of the three measured surface potentials was taken to be a charge potential $V_{01}$ (unit: +V) before printing test.

Next, a printing test was performed. In the printing test, an image B (print pattern image having a printing rate of 5%) was printed on 10,000 recording medium (A4 size paper) sheets at regular intervals of 15 seconds using the evaluation apparatus. Immediately after the printing test, the image A (entirely white image) was printed on three recording medium (A4 size paper) sheets. In printing on each sheet, the surface potential of the single-layer photosensitive member was measured at the development position. The surface potential was measured once per sheet, 3 times in total. The average value of the three measured surface potentials was taken to be a charge potential $V_{02}$ (unit: +V) after printing test.

A value ($V_{01}$-$V_{02}$) obtained by subtracting the charge potential $V_{02}$ after the printing test from the charge potential $V_{01}$ before the printing test was taken to be an amount of decrease in charge potential $\Delta V_0$ (unit: V). Amounts of decrease in charge potential $\Delta V_0$ are shown in Tables 5 and 6. A smaller amount of decrease in charge potential $\Delta V_0$ (unit: V) indicates a better charging stability of a single-layer photosensitive member.

portion on the photosensitive layer was examined. Based on the examination result, whether or not crystallization was inhibited was evaluated in accordance with the following evaluation criteria. The evaluation results are shown in Tables 5 and 6. Note that a single-layer photosensitive member rated as C was evaluated as having a photosensitive layer in which crystallization was not inhibited.

(Evaluation Criteria of Crystallization Inhibition)

Evaluation A: No crystallized portions were observed.

Evaluation B: A slightly crystallized portion was observed.

Evaluation C: A crystallized portion was clearly observed.

In Tables 5 and 6, HTM, Resin, ETM, $V_L$, and $\Delta V_0$ represent hole transport material, binder resin, electron transport material, post-exposure potential value, and amount of decrease in charge potential, respectively. In Tables 5 and 6, Photosensitive Member represents single-layer photosensitive member, and Photosensitive Layer represents single-layer photosensitive layer. In table 5, Content represents content percentage of the charge transport material relative to the mass of the photosensitive layer (unit: wt %, i.e., % by mass).

TABLE 5

| | | Photosensitive Layer | | | | Evaluation | | |
|---|---|---|---|---|---|---|---|---|
| | | | | ETM | | Charging | | |
| | Photosensitive Member | HTM | Resin | Type | Content (wt %) | Sensitivity $V_L$ (+V) | Stability $\Delta V_0$ (V) | Crystallization Inhibition |
| Example 1 | A-1 | 1-1 | R-1 | E-1 | 18.4 | 108 | 19 | A |
| Example 2 | A-2 | 1-1 | R-1 | E-1 | 23.9 | 91 | 7 | A |
| Example 3 | A-3 | 1-1 | R-1 | E-1 | 29.3 | 83 | 5 | A |
| Example 4 | A-4 | 1-2 | R-1 | E-1 | 22.3 | 102 | 9 | A |
| Example 5 | A-5 | 1-3 | R-1 | E-1 | 22.3 | 110 | 17 | B |
| Example 6 | A-6 | 1-1 | R-1 | E-2 | 18.4 | 129 | 18 | A |
| Example 7 | A-7 | 1-1 | R-1 | E-2 | 23.9 | 110 | 12 | A |
| Example 8 | A-8 | 1-1 | R-1 | E-2 | 29.3 | 98 | 8 | A |
| Example 9 | A-9 | 1-1 | R-1 | E-3 | 18.4 | 115 | 16 | A |
| Example 10 | A-10 | 1-1 | R-1 | E-3 | 23.9 | 102 | 13 | A |
| Example 11 | A-11 | 1-1 | R-1 | E-3 | 29.3 | 95 | 9 | A |
| Example 12 | A-12 | 1-1 | R-2 | E-1 | 18.4 | 105 | 17 | A |
| Example 13 | A-13 | 1-2 | R-2 | E-1 | 18.4 | 108 | 18 | A |
| Comparative Example 1 | B-1 | 1-1 | R-3 | E-1 | 22.3 | 110 | 40 | A |
| Comparative Example 2 | B-2 | H-4 | R-1 | E-1 | 22.3 | 113 | 56 | A |
| Comparative Example 3 | B-3 | H-5 | R-1 | E-1 | 22.3 | 172 | 20 | C |
| Comparative Example 4 | B-4 | H-6 | R-1 | E-1 | 22.3 | 163 | 44 | C |
| Comparative Example 5 | B-5 | H-7 | R-1 | E-1 | 22.3 | 115 | 95 | A |
| Comparative Example 6 | B-6 | H-8 | R-1 | E-1 | 22.3 | 139 | 55 | C |
| Comparative Example 7 | B-7 | H-9 | R-1 | E-1 | 22.3 | 142 | 42 | C |
| Comparative Example 8 | B-8 | H-10 | R-1 | E-1 | 22.3 | 152 | 40 | C |
| Comparative Example 9 | B-9 | H-11 | R-1 | E-1 | 22.3 | 145 | 43 | C |
| Comparative Example 10 | B-10 | H-12 | R-1 | E-1 | 22.3 | 144 | 49 | C |
| Comparative Example 11 | B-11 | H-13 | R-1 | E-1 | 22.3 | 138 | 51 | C |
| Comparative Example 12 | B-12 | H-14 | R-1 | E-1 | 22.3 | 145 | 50 | C |

<Evaluation of Crystallization Inhibition for Single-Layer Photosensitive Members>

The entire surface (photosensitive layer) of each single-layer photosensitive members (A-1) to (A-13), (B-1) to (B-12), (C-1) to (C-4), and (D-1) to (D-13) was observed with the naked eye. The presence or absence of a crystallized As shown in Table 5, the single-layer photosensitive layers of the single-layer photosensitive members (A-1) to (A-13) contained the compound (1) (more specifically, one of the compounds (1-1) to (1-3)) as a hole transport material. The single-layer photosensitive layers of the single-layer photosensitive members (A-1) to (A-13) contained a polyarylate resin (PA) having at least one repeating unit (10) and at least one repeating unit (11) (more specifically, one of the polyarylate resins (R-1) and (R-2)). As a result, the single-layer photosensitive members (A-1) to (A-13) each had an amount of decrease in charge potential $\Delta V_0$ of no greater than 19 V. In addition, the single-layer photosensitive members (A-1) to (A-13) were each evaluated as A or B for the crystallization inhibition. Therefore, in the single-layer photosensitive members (A-1) to (A-13), improved charging stability and inhibition of crystallization of the photosensitive layer were both achieved. The single-layer photosensitive members (A-1) to (A-13) each had a post-exposure potential value $V_L$ of at least +83 V and no greater than +129 V, which means that improved charging stability and inhibition of crystallization of the photosensitive layer were both achieved without impairment of the sensitivity characteristics.

TABLE 6

| | Photosensitive Member | Photosensitive Layer HTM | Resin | ETM | Evaluation Sensitivity $V_L$ (+V) | Charging Stability $\Delta V_0$ (V) | Crystallization Inhibition |
|---|---|---|---|---|---|---|---|
| Example 14 | C-1 | 1-1 | PC-1 | E-1 | 106 | 12 | A |
| Example 15 | C-2 | 1-2 | PC-1 | E-1 | 100 | 7 | A |
| Example 16 | C-3 | 1-2 | PC-2 | E-1 | 101 | 9 | A |
| Example 17 | C-4 | 1-3 | PC-1 | E-1 | 108 | 14 | B |
| Comparative Example 13 | D-1 | 1-1 | PC-3 | E-1 | 112 | 36 | A |
| Comparative Example 14 | D-2 | 1-1 | PC-4 | E-1 | 177 | 8 | C |
| Comparative Example 15 | D-3 | H-4 | PC-1 | E-1 | 110 | 43 | A |
| Comparative Example 16 | D-4 | H-5 | PC-1 | E-1 | 165 | 17 | C |
| Comparative Example 17 | D-5 | H-6 | PC-1 | E-1 | 158 | 41 | C |
| Comparative Example 18 | D-6 | H-7 | PC-1 | E-1 | 110 | 89 | A |
| Comparative Example 19 | D-7 | H-8 | PC-1 | E-1 | 142 | 45 | C |
| Comparative Example 20 | D-8 | H-9 | PC-1 | E-1 | 154 | 55 | C |
| Comparative Example 21 | D-9 | H-10 | PC-1 | E-1 | 139 | 41 | C |
| Comparative Example 22 | D-10 | H-11 | PC-1 | E-1 | 145 | 49 | C |
| Comparative Example 23 | D-11 | H-12 | PC-1 | E-1 | 144 | 40 | C |
| Comparative Example 24 | D-12 | H-13 | PC-1 | E-1 | 141 | 30 | C |
| Comparative Example 25 | D-13 | H-14 | PC-1 | E-1 | 145 | 48 | C |

As shown in Table 6, the single-layer photosensitive layers of the single-layer photosensitive members (C-1) to (C-4) contained the compound (1) (specifically, one of the compounds (1-1) to (1-3)) as a hole transport material. The single-layer photosensitive layers of the single-layer photosensitive members (C-1) to (C-4) contained a polycarbonate resin (PC) having the repeating unit (20) and the repeating unit (21) (more specifically, one of the polycarbonate resins (PC-1) and (PC-2)). The single-layer photosensitive members (C-1) to (C-4) each had an amount of decrease in charge potential $\Delta V_0$ of no greater than 14 V. In addition, the single-layer photosensitive members (C-1) to (C-4) were each evaluated as A or B for the crystallization inhibition. Therefore, in the single-layer photosensitive members (C-1) to (C-4), improved charging stability and inhibition of crystallization of the photosensitive layer were both achieved. The single-layer photosensitive members (C-1) to (C-4) each had a post-exposure potential value $V_L$ of at least +100 V and no greater than +108 V, which means that improved charging stability and inhibition of crystallization of the photosensitive layer were both achieved without impairment of the sensitivity characteristics.

From the above, it was shown that the photosensitive member according to the present disclosure can achieve both improved charging stability and inhibition of crystallization of the photosensitive layer. Since the photosensitive member according to the present disclosure can achieve both improved charging stability and inhibition of crystallization of the photosensitive layer, the process cartridge and the image forming apparatus according to the present disclosure can form favorable images.

What is claimed is:

1. An electrophotographic photosensitive member comprising:

a conductive substrate; and a photosensitive layer of a single layer, wherein the photosensitive layer includes at least a charge generating material, a hole transport material, a binder resin, and an electron transport material, the hole transport material includes a compound represented by a general formula (1), and the binder resin includes a polyarylate resin represented by a chemical formula (R-1) or (R-2)

(1)

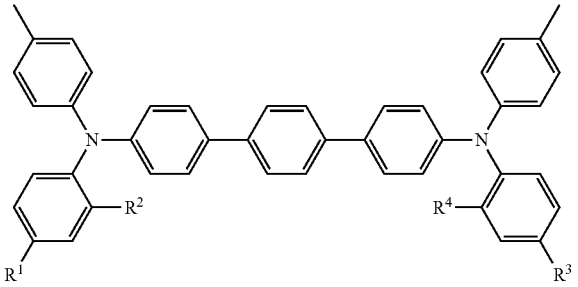

where in the general formula (1), $R^1$ and $R^2$ each represent, independently of each other, a hydrogen atom, a methyl group, or an ethyl group, and a sum of the carbon number of a group represented by $R^1$ and the carbon number of a group represented by $R^2$ is 2, and $R^3$ and $R^4$ each represent, independently of each other, a hydrogen atom, a methyl group, or an ethyl group, and the sum of the carbon number of a group represented by $R^3$ and the carbon number of a group represented by $R^4$ is 2, (R-1)

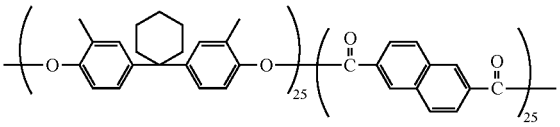

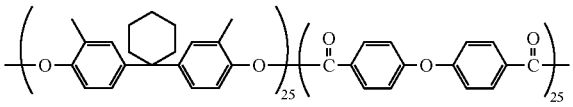

(R-2)

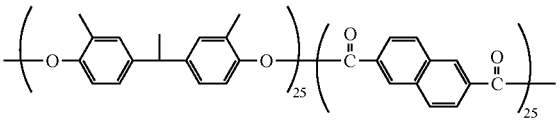

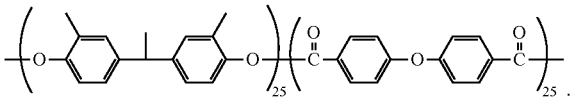

2. The electrophotographic photosensitive member according to claim 1, wherein the compound represented by the general formula (1) is a compound represented by a chemical formula (1-1), (1-2), or (1-3):

(1-1)

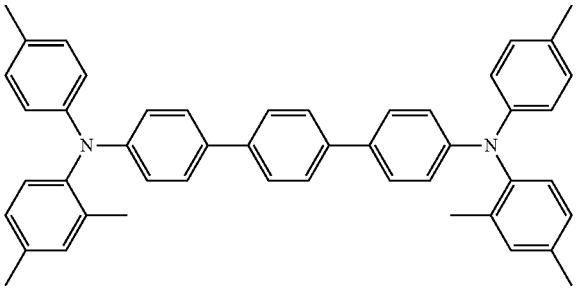

(1-2)

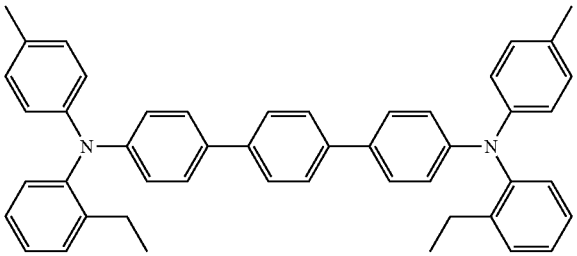

(1-3)

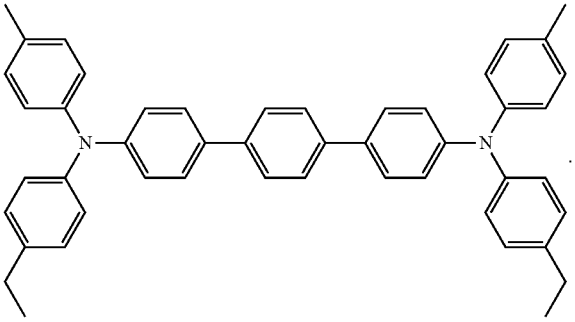

3. The electrophotographic photosensitive member according to claim 2, wherein the compound represented by the general formula (1) is the compound represented by the chemical formula (1-1) or (1-2).

4. The electrophotographic photosensitive member according to claim 1, wherein the electron transport material includes a compound represented by the general formula (30), (31), or (32):

(30)

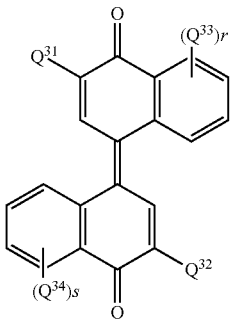

-continued (31)

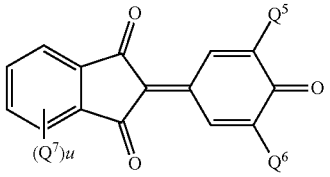

(32)

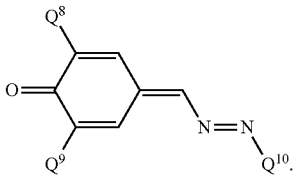

wherein in the general formula (30), $Q^{31}$ and $Q^{32}$ each represent, independently of each other, a hydrogen atom, an alkyl group having a carbon number of at least 1 and no greater than 8, a phenyl group, or an alkoxy group having a carbon number of at least 1 and no greater than 8; $Q^{33}$ and $Q^{34}$ each represent, independently of each other, an alkyl group having a carbon number of at least 1 and no greater than 8, a phenyl group, or an alkoxy group having a carbon number of at least 1 and no greater than 8; and r and s each represent, independently of each other, an integer of at least 0 and no greater than 4, in the general formula (31), $Q^5$ and $Q^6$ each represent, independently of each other, a hydrogen atom, an alkyl group having a carbon number of at least 1 and no greater than 8, a phenyl group, or an alkoxy group having a carbon number of at least 1 and no greater than 8; $Q^7$ represents an alkyl group having a carbon number of at least 1 and no greater than 8, a phenyl group, or an alkoxy group having a carbon number of at least 1 and no greater than 8; and u represents an integer of at least 0 and no greater than 4 and, in the general formula (32), $Q^8$ and $Q^9$ each represent, independently of each other, a hydrogen atom or an alkyl group having a carbon number of at least 1 and no greater than 6, and $Q^{10}$ represents an aryl group having a carbon number of at least 6 and no greater than 14 and being optionally substituted with a halogen atom.

5. The electrophotographic photosensitive member according to claim 4, wherein the electron transport material includes the compound represented by the general formula (31).

6. The electrophotographic photosensitive member according to claim 4, wherein the compound represented by the general formula (30) is a compound represented by a chemical formula (E-1), the compound represented by the general formula (31) is a compound represented by a chemical formula (E-2), and the compound represented by the general formula (32) is a compound represented by a chemical formula (E-3)

(E-1)

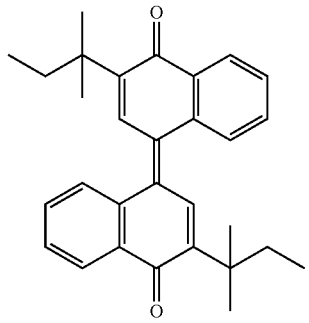

(E-2)

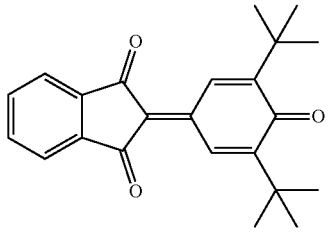

(E-3)

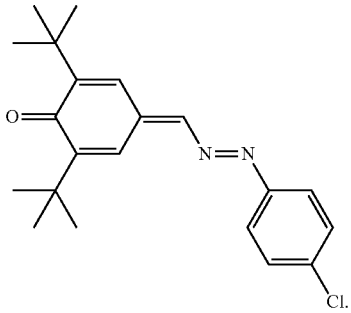

7. The electrophotographic photosensitive member according to claim 4, wherein a content percentage of the electron transport material relative to the mass of the photosensitive layer is at least 18.0% by mass and no greater than 30.0% by mass.

8. A process cartridge comprising the electrophotographic photosensitive member according to claim 1.

9. An image forming apparatus, comprising:

an image bearing member;

a charger configured to charge a surface of the image bearing member;

a light exposure device configured to form an electrostatic latent image on the surface of the image bearing member by exposing the charged surface of the image bearing member to light;

a developing device configured to develop the electrostatic latent image into a toner image, and a transfer device configured to transfer the toner image from the image bearing member to a transfer target, wherein the image bearing member is the electrophotographic photosensitive member according to claim 1.

10. The image forming apparatus according to claim 9, wherein the transfer target is a recording medium, and the transfer device is configured to transfer the toner image from the image bearing member to the recording medium in a state where the surface of the image bearing member and the recording medium are in contact with each other.

11. The image forming apparatus according to claim 9, wherein the developing device is configured to develop the electrostatic latent image into the toner image while in contact with the surface of the image bearing member.

12. The image forming apparatus according to claim 9, wherein the charger is a scorotron charger.

13. The image forming apparatus according to claim 9, further comprising a cleaning roller configured to polish the surface of the image bearing member to collect toner adhering to the surface of the image bearing member.

* * * * *